US006461387B1

(12) United States Patent
Jureller et al.

(10) Patent No.: US 6,461,387 B1
(45) **Date of Patent: *Oct. 8, 2002**

(54) DRY CLEANING SYSTEM WITH LOW HLB SURFACTANT

(75) Inventors: Sharon Harriott Jureller, Haworth; Judith Lynne Kerschner, Fairlawn; Dennis Stephen Murphy, Leonia, all of NJ (US)

(73) Assignee: Lever Brothers Company, division of Conopco, Inc., New York, NY (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/507,483

(22) Filed: Feb. 4, 2000

Related U.S. Application Data

(63) Continuation of application No. 09/081,401, filed on May 19, 1998, now Pat. No. 6,148,644, which is a continuation-in-part of application No. 08/798,659, filed on Feb. 11, 1997, now abandoned, which is a continuation-in-part of application No. 08/700,176, filed on Aug. 20, 1996, now abandoned, which is a continuation-in-part of application No. 08/399,318, filed on Mar. 6, 1995, now Pat. No. 5,683,977.

(51) Int. Cl.[7] ..... C11D 3/16; C11D 1/66; C11D 1/83

(52) U.S. Cl. ..... 8/142; 8/137; 510/285; 510/289; 510/290; 510/291; 510/466

(58) Field of Search ..... 510/285, 289, 510/290, 291, 466; 8/137, 142

(56) References Cited

U.S. PATENT DOCUMENTS

| | | | | |
|---|---|---|---|---|
| 3,042,479 | A | 7/1962 | Lawrence et al. | 8/142 |
| 3,686,125 | A | 8/1972 | Miller | 8/142 |
| 3,776,693 | A | 12/1973 | Smith et al. | 87/142 |
| 4,012,194 | A | 3/1977 | Maffei | 374/167 |
| 4,104,409 | A | 8/1978 | Vixthum et al. | 426/386 |
| 4,123,559 | A | 10/1978 | Vixthum et al. | 426/312 |
| 4,925,790 | A | 5/1990 | Blanch et al. | 435/52 |
| 5,152,933 | A | 10/1992 | Holland | 510/340 |
| 5,158,704 | A | 10/1992 | Fulton et al. | 516/9 |
| 5,238,587 | A | 8/1993 | Smith et al. | 510/277 |
| 5,267,455 | A | 12/1993 | Dewees et al. | 68/52 |
| 5,279,615 | A | 1/1994 | Mitchell et al. | 8/142 |
| 5,290,827 | A | 3/1994 | Shine | 523/340 |
| 5,312,882 | A | 5/1994 | DeSimone et al. | 526/201 |
| 5,316,591 | A | 5/1994 | Chao et al. | 134/34 |
| 5,339,844 | A | 8/1994 | Stanford, Jr. et al. | 134/107 |
| 5,358,046 | A | 10/1994 | Sydansk et al. | 166/275 |

(List continued on next page.)

FOREIGN PATENT DOCUMENTS

| | | |
|---|---|---|
| DE | 2 250 933 | 5/1974 |
| DE | 39 04 514 | 8/1990 |
| EP | 518 653 | 12/1992 |
| EP | 530 949 | 3/1993 |
| WO | 97/16264 | 5/1997 |
| WO | 99/10587 | 3/1999 |

OTHER PUBLICATIONS

US 6,001,133, 12/1999, DeYoung et al. (withdrawn)
"Effect of Surfactants on the Interfacial Tension and Emulsion Formation between Water and Carbon Dioxide"; Langmuir 1999, vol. 15, pp. 419–428 (1998).

(List continued on next page.)

*Primary Examiner*—Gregory Delcotto
(74) *Attorney, Agent, or Firm*—Edward A. Squillante, Jr.

(57) ABSTRACT

A system for dry cleaning soils from fabrics comprising densified carbon dioxide and a surfactant in the densified $CO_2$. The densified carbon dioxide is in a temperature range of about −78.5° C. to about 100° C. and a pressure range of about 14.7 to about 10,000 psi. At least 0.1% by volume of a modifier is preferably present. The surfactant has a polysiloxane a branched polyalkylene oxide or a halocarbon group which is a functional $CO_2$-philic moiety connected to a $CO_2$-phobic functional moiety. The surfantant either exhibits an HLB of less than 15 or has a ratio of siloxyl to substituted siloxyl groups of greater than 0.5:1.

12 Claims, 1 Drawing Sheet

U.S. PATENT DOCUMENTS

| | | | | |
|---|---|---|---|---|
| 5,370,742 | A | 12/1994 | Mitchell et al. | 134/10 |
| 5,412,958 | A | 5/1995 | Iliff et al. | 68/52 |
| 5,431,843 | A | 7/1995 | Mitchell et al. | 252/186.38 |
| 5,456,759 | A | 10/1995 | Stanford, Jr. et al. | 134/1 |
| 5,467,492 | A | 11/1995 | Chao et al. | 8/159 |
| 5,486,212 | A | 1/1996 | Mitchell et al. | 8/142 |
| 5,610,128 | A | 3/1997 | Zyhowski et al. | 510/288 |
| 5,676,705 | A | 10/1997 | Jureller et al. | 8/142 |
| 5,683,473 | A | 11/1997 | Jureller et al. | 510/286 |
| 5,683,977 | A | 11/1997 | Jureller et al. | 8/146 |
| 5,741,760 | A | 4/1998 | Mondin et al. | 510/365 |
| 5,746,776 | A | 5/1998 | Smith et al. | 8/142 |
| 5,759,209 | A | 6/1998 | Adler et al. | 510/365 |
| 5,759,983 | A | 6/1998 | Mondin et al. | 8/142 |
| 5,783,082 | A | 7/1998 | DeSimone et al. | 210/634 |
| 5,789,505 | A | 8/1998 | Wilkinson et al. | 526/209 |
| 5,858,022 | A | 1/1999 | Romack et al. | 8/142 |
| 5,863,298 | A | 1/1999 | Fulton et al. | 8/138 |
| 5,866,005 | A | 2/1999 | DeSimone et al. | 210/634 |
| 5,881,577 | A | 3/1999 | Sauer et al. | |
| 5,904,737 | A | 5/1999 | Preston et al. | 8/158 |
| 5,925,192 | A | 7/1999 | Purer et al. | 134/16 |
| 5,944,996 | A | 8/1999 | DeSimone et al. | 210/634 |
| 5,977,045 | A | 11/1999 | Murphy | 510/289 |

FOREIGN PATENT DOCUMENTS

Consani, K.A. "Observations on the Solubility of Surfactants and Related Molecules in Carbon Dioxide at 50°C" Journal of Supercritical Fluids, 1990, vol. 3, pp. 51–65.

Aggregation of Amphiphilic Molecules in Supercritical Carbon Dioxide: A Small Angle X–ray Scattering Study, Fulton et al., Langml 1995. vol. 11, pp. 4241–4249 (1995).

McFann, G. "Formation and Phase Behavior of Reverse Micelles and Microemulsions in Supercritical Fluid Ethane, Propane and Carbon Dioxide", Chapter 5, Dissertation University of Texas—Austin 1993, pp. 216–306.

Grant, D.J.W. et al., "Solubility Behavior of Organic Compounds", Techniques of Chemistry Series, J. Wiley & Sons, (NY 1990) pp. 46–55 describing Hildebrand equation.

Attwood, D. "Surfactant Systems Their Chemistry, Pharmacy and Biology", 1983, pp. 472–474 (1983).

"Biocatalysts for Industry" pp. 219–237, (1991) (Plenum) edited by J. Dordice—Biocatalysts in Supercritical Fluids.

Gerbert, B. et al., "Supercritical $CO_2$ as Replacement for Perchloroethylene", Translation of Melliand Textilberichte 74 (1993), p. 151, 152; (1993).

Hoefling, T. et al., "The Incorporation of a Fluorinated Ether Functionality into a Polymer or Surfactant to Enhance $CO_2$–Solubility" Journal of Supercritical Fluids, U.S. #4 (1992), vol. 51, pp. 237–241; (1992).

Newman, D.A., et al., "Phase Behavior of FluoroetherFunctional Amphiphiles in Supercritical Carbon Dioxide", The Journal of Supercritical Fluids. (1993). vol. 6, pp. 205–210; (1993).

Hardman et al., "Encyclopedia of Polymer Science and Engineering, Second Edition, vol. 15, pp. 204–308; (1990).

DRY CLEANING SYSTEM WITH LOW HLB SURFACTANT

RELATED APPLICATION

This application is a continuation of U.S. Ser. No. 09/081,401, now U.S. Pat. No. 6,148,644 filed on May 19, 1998 which is a continuation-in-part of U.S. Ser. No. 08/798,659, filed Feb. 11, 1997, now abandoned, which is a continuation-in-part of U.S. Ser. No. 08/700,176, filed Aug. 20, 1996, now abandoned, which is a continuation of U.S. Ser. No. 08/399,318, field Mar. 6, 1995, now U.S. Pat. No. 5,683,977.

FIELD OF THE INVENTION

This invention pertains to a dry cleaning system utilizing densified carbon dioxide and a surfactant adjunct.

BACKGROUND OF THE INVENTION

Densified, particularly supercritical fluid, carbon dioxide has been suggested as an alternative to halo-carbon solvents used in conventional dry cleaning. For example, a dry cleaning system in which chilled liquid carbon dioxide is used to extract soils from fabrics is described in U.S. Pat. No. 2,012,194 issued to Maffei on Mar. 15, 1977.

Densified carbon dioxide provides a nontoxic, inexpensive, recyclable and environmentally acceptable solvent to remove soils in the dry cleaning process. The supercritical carbon dioxide has been shown to be effective in removing nonpolar stains such as motor oil, when combined with a viscous cleaning solvent particularly mineral oil or petrolatum as described in U.S. Ser. No. 715,299, filed Jun. 14, 1991, assigned to The Clorox Company and corresponding to EP 518,853. Supercritical fluid carbon dioxide has been combined with other components, such as a source of hydrogen peroxide and an organic bleach activator as described in U.S. Ser. No. 754,809, filed Sep. 4, 1991 and owned by The Clorox Company, corresponding to EP 530,949.

A system of dry cleaning fabrics using liquid carbon dioxide under stirring and optionally including conventional detergent surfactants and solvents is described in U.S. Pat. No. 5,467,492 corresponding to JP 08052297 owned by Hughes Aircraft Co.

The solvent power of densified carbon dioxide is low relative to ordinary liquid solvents and the carbon dioxide solvent alone is less effective on hydrophilic stains such as grape juice, coffee and tea and on compound hydrophobic stains such as lipstick and red candle wax, unless surfactants and solvent modifiers are added.

A cleaning system combining particular anionic or nonionic surface active agents with supercritical fluid $CO_2$ is described in DE 39 04 514 A1 published Aug. 23, 1990. These anionic and nonionic agents, such as alkylenebenzene sulfates and sulfonates, ethoxylated alkylene phenols and ethoxylated fatty alcohols were particularly effective when combined with a relatively large amount of water (greater than or equal to 4%). The patented system appears to combine the detergency mechanism of conventional agents with the solvent power of supercritical fluid carbon dioxide.

It has been observed that most commercially available surfactants have little solubility in supercritical fluid carbon dioxide as described in Consani, K. A., *J. Sup. Fluids,* 1990 (3), pages 51–65. Moreover, it has been observed that surfactants soluble in supercritical fluid carbon dioxide become insoluble upon the addition of water. No evidence for the formation of water-containing reversed micelles with the surfactants was found. Consani supra.

Thus, the dry cleaning systems known in the art have merely combined cleaning agents with various viscosities and polarities with supercritical fluid $CO_2$ generally with high amounts of water as a cosolvent. The actives clean soils as in conventional washing without any synergistic effect with the $CO_2$ solvent.

The formation of water-containing reversed micelles is believed to be critical for the solubility and removal of hydrophilic stains. Studies of the interaction of surfactants in supercritical carbon double with water, cosurfactants and cosolvents led to the conclusion that most commercially available surfactants are not designed for the formation of reversed micelles in supercritical carbon dioxide as described in McFann. G., Dissertation, University of Texas at Austin, pp. 216–306, 1993.

The present invention provides an improved dry cleaning system utilizing densified carbon dioxide to clean a variety of consumer soils on fabrics.

SUMMARY OF THE INVENTION

The present invention provides a dry cleaning system utilizing an environmentally safe, nonpolar solvent such as densified carbon dioxide preferably in combination with a specified amount of a modifier, preferably water to effectively remove a variety of soils on fabrics. Particular surfactants useful in the drycleaning system are also described.

In one aspect of the present invention, the dry cleaning used for cleaning a variety of soiled fabrics comprises densified carbon dioxide and about 0.001% to about 5% of a surfactant. The surfactant has a densified $CO_2$-philic functional moiety connected to a densified $CO_2$-phobic functional moiety. Preferred $CO_2$-philic moieties of the surfactant include halocarbons such as fluorocarbons, chlorocarbons and mixed fluorochlorocarbons, polysiloxanes, and branched polyalkyleneene oxides. The $CO_2$-phobic groups for the surfactant contain preferably polyalkeneene oxides, carboxylates. $C_{1-30}$ alkylene sulfonates, carbohydrates, glycerates, phosphates, sulfates and $C_{1-30}$ hydrocarbons.

The dry cleaning system preferably contains a specific amount of a modifier, such as water, or an organic solvent. Optionally a bleaching agent such as a peracid is also included.

A method for dry cleaning a variety of soiled fabrics is also described wherein a selected surfactant, and a modifier, and optionally a bleaching agent or mixtures thereof are combined and the cloth is contacted with the mixture. Densified carbon dioxide is introduced into a cleaning vessel which is then pressurized from about 14.7 psi to about 10,000 psi the temperature is adjusted to a range of about −78.5° C. to about 100° C. Fresh densified carbon dioxide may be used to flush the cleaning vessel.

DETAILED DESCRIPTION OF PREFERRED EMBODIMENTS

Figure 1:
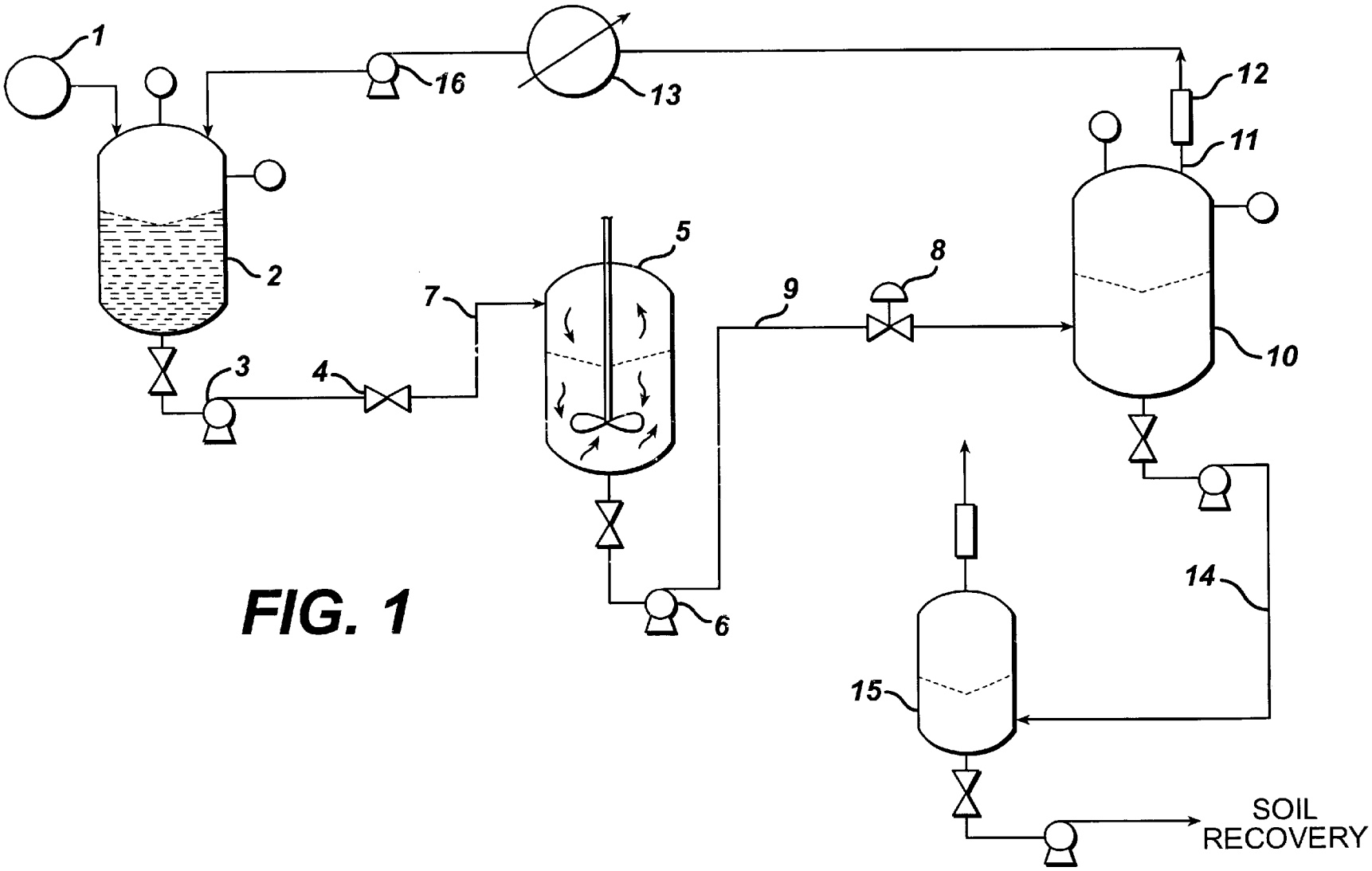
FIG. 1 is a diagrammatic flow chart of the densified carbon dioxide dry cleaning process according to the invention.

The invention provides a dry cleaning system which replaces conventional solvents with a combination of densified carbon dioxide, a modified and selected cleaning surfactants. Optionally, bleaching agents and mixtures thereof are added to provide a total cleaning system.

For purposes of the invention, the following definitions are used.

"Densified carbon dioxide" means carbon dioxide that has a density (g/ml) greater than that of carbon dioxide gas at 1 atm, and 20° C.

"Supercritical fluid carbon dioxide" means carbon dioxide which is at or above the critical temperature of 31° C. and the critical pressure of 71 atmospheres and which cannot be condensed into a liquid phase despite the addition of further pressure.

The term "densified carbon dioxide-philic" in reference to surfactants $R_nZ_{15}$ wherein n and $n^5$ are each independently 1 to 50, means that the functional group. $R_nH$ is soluble in carbon dioxide at pressures of about 14.7 to about 10,000 psi and temperatures of about −78.5° C. to about 100° C. to greater than 10 weight percent. Preferably n and $n^5$ are each independently 1–35. Such functional groups ($R_1H$) include halocarbons, polysiloxanes and branched polyalkylene oxides.

The term "densified carbon dioxide-phobic" in reference to surfactants, $R_nZ_{n5}$, means that $Z_{n5}H$ will have a solubility in carbon dioxide at pressures of about 14.7 to about 10,000 psi and temperatures of about −78.5° C. to about 100° C. of less than 10 weight percent. The functional groups in $Z_{n5}H$ include carboxylic acids. phosphatyl esters, hydroxyls, $C_{1-30}$ alkylenes or alkenylenes, polyalkylene oxides branched polyalkylene oxides, carboxylates, $C_{1-30}$ alkylene sulfonates, phosphates, glycerates, carbohydrates nitrates, substituted or unsubstituted arylenes and sulfates.

The hydrocarbon and halocarbon containing surfactants (i.e. $R_nZ_{n5}$, containing the $CO_2$-philic functional group. $R_nH$, and the $CO_2$-phobic group, $Z_{n5}H$) will have an HLB of less than 15, preferably less than 13 and most preferably less than 12.

The polymeric siloxane containing surfactsnts, $R_nZ_{n5}$, also designated $MD_xD^*_yM$, with M representing trimethylsiloxyl end groups, $D_x$ as a dimethylsiloxy backbone ($CO_2$-philic functional group) and $D^*_y$ as one or more substituted methylsiloxyl groups substituted with $CO_2$-phobic $R^2$ or $R^3$ groups as described in the Detailed Description Section will have a $D_xD^*_y$ ratio of greater than 0.5:1, preferably greater than 0.7:1 and most preferably greater than 1.1.

The term "nonpolar stains" refers to those which are at least partially made by nonpolar organic compounds such as oil soils, sebum and the like.

The term "polar stains" is interchangeable with the term "hydrophilic stains" and refers to stains such as grape juice, coffee and tea.

The term "compounds hydrophobic stains" refers to stains such as lipstick and red candle wax.

The term "particular soils" means soils containing insoluble solid components such as silicates carbon black, etc.

Densified carbon dioxide, preferably liquid or supercritical fluid carbon dioxide, is used in the inventive dry cleaning system. It is noted that other molecules having densified properties may also be employed alone or in mixture. These molecules include methane, ethane, propane, ammonia, butane, n-pentane, n-hexane, cyclohexane, n-heptane, ethylene, propylene, methanol ethanol, isopropanol, benzene, toluene, p-xylene, sulfur dioxide chlorotrifluoromethane, trichlorofluoromethane, perfluoropropane, chlorodifluoromethane, sulfur hexafluoride and nitrous oxide.

During the dry cleaning process, the temperature range is between about −78.5° C. and about 100° C. preferably about −56.2° C. to about 60° C. and most preferably about 0° C. to about 60° C. The pressure during cleaning is about 14.7 psi to about 10,000 psi, preferably about 75.1 psi to about 7,000 psi and most preferably about 300 psi to about 6,000 psi.

A "substituted methylsiloxy group" is a methylsiloxy group substituted with a $CO_2$-phobic group $R^2$ or $R^3$, $R^2$ or $R^3$ are each represented in the following formula:

$$—(CH_2)_a(C_6H_4)_b(A)_d==[(L)_e(A')_f]_n==(L')_gZ^2(G)_h$$

wherein a is 1–30, b is 0–1, $C_5H_4$ is substituted or unsubstituted with a $C_{1-10}$ alkylene or alkenylene and A, d, L, e, A', F, n L', g, $Z^2$, G and h are defined below, and mixtures of $R^2$ and $R^3$.

A "substituted arylene" is an arylene substituted with a $C_{1-30}$ alkylene, alkenylene or hydroxyl, preferably a $C_{1-20}$ alkylene or alkenylene.

A "substituted carbohydrate" is a carbohydrate substituted with a $C_{1-10}$ alkylene or alkenylene, preferably a $C_{1-5}$ alkylene.

The terms "polyalkylene oxide" "alkylene" and "alkenylene" each contain a carbon chain which may be either straight or branched unless otherwise stated.

Surfactant Adjunct

A surfactant which is effective for use in a densified carbon dioxide dry cleaning system requires the combination of densified carbon dioxide-philic functional groups with densified carbon dioxide-phobic functional groups (see definitions above). The resulting compound may form reversed micelles with the $CO_2$-philic functional groups extending into a continuous phase and the $CO_2$-phobic functional groups directed toward the center of the micelle.

The surfactant is present in an amount of from 0.001 to 10 wt. %, preferably 0.01 to 5 wt. %.

The $CO_2$-philic moieties, of the surfactants are groups exhibiting low Hildebrand solubility parameters, as described in Grant D. J. W. et al. "Solubility Behavior of Organic Compounds", Techniques of Chemistry Series, J. Wiley & Sons, N.Y. (1990) pp. 46–55 which describes the Hildebrand solubility equation, herein incorporated by reference. These $CO_2$-philic moieties also exhibit low polarizability and some electron donating capability allowing them to be solubilized easily in densified fluid carbon dioxide.

As defined above the $CO_2$-philic functional groups are soluble in densified carbon dioxide to greater than 10 weight percent preferably greater than 15 weight percent, at pressures of about 14.7 to about 10,000 psi and temperatures of about −78.5° C. to about 100° C.

Preferred densified $CO_2$-philic functional groups include halocarbons (such as fluorochloro- and fluorochlorocarbons), polysiloxanes and branched polyalkylene oxides.

The $CO_2$-phobic portion of the surfactant molecule is obtained either by a hydrophilic or a hydrophobic functional groups which is less than 10 weight percent soluble in densified $CO_2$, preferably less than 5 wt. %, at a pressures of about 14.7 to about 10,000 psi and temperatures of about −78.5° C. to about 100° C. Examples of moieties contained in the $CO_2$-phobic groups include polyalkylene oxides, carboxylates, branched acrylate esters, $C_{1-30}$ hydrocarbons, phenylenes which are unsubstituted or substituted, sulfonates, glycerates, phosphates, sulfates and carbohydrates. Especially preferred $CO_2$-phobic groups include $C_{2-20}$ straight chain or branched alkylenes, polyalkylene oxides, glycerates, carboxylates, phosphates, sulfates and carbohydrates.

The $CO_2$-philic and $CO_2$-phobic groups may be directly connected or linked together via a linkage group. Such groups include ester, keto, ether, amide, amine, thio, alkylene, alkenylene, fluoroalkylene or fluoroalkenylene.

Surfactants which are useful in the invention may be selected from four groups of compounds. The first group of compounds has the following formula:

$$[(CX_3(CX_2)_a(CH_2)_b)_c(A)_d{=}{=}[(L)_e{=}{=}(A')_f]_n{=}{=}(L')_g]_oZ^2(G)_h \qquad (I)$$

wherein X is F, Cl, Br, I and mixtures thereof, preferably F and Cl.

a is 1–30, preferably 1–25, most preferably 5–20.

b is 0–5, preferably 0–3;

c is 1–5, preferably 1–3;

A and A' are each independently a linking moiety representing an ester, a keto, an ether, a thio, an amido, an amino, a $C_{1-4}$ fluoroalkylene, a $C_{1-4}$ fluoroalkenylene, a branched or straight chain polyalkylene oxide, a phosphato, a sulfonyl, a sulfate, an ammonium and mixtures thereof.

d is 0 or 1;

L and L' are each independently a $C_{1-30}$ straight chained or branched alkylene or alkenylene or phenylene which is unsubstituted or substituted and mixtures thereof;

e is 0–3.

f is 0 or 1;

n is 0–10, preferably 0–5, most preferably 0–3.

g is 0–3;

o is 0–5 preferably 0–3;

$Z^2$ is a hydrogen, a carboxylic acid, a hydroxyl, a phosphato, a phosphato ester, a sulfonyl, a sulfonate, a sulfate, a branched or straight-chained polyalkylene oxide, a nitryl, a glyceryl, a phenylene unsubstituted or substituted with a $C_{1-30}$ alkylene or alkenylene, (preferably $C_{1-25}$ alkylene), a carbohydrate unsubstituted or substituted with a $C_{1-10}$ alkylene or alkenylene (preferably a $C_{1-5}$ alkylene) or an ammonium.

G is an anion or cation such as $H^+$, $Na^+$, $Li^+$, $K^+$, $NH_4^+Ca^{+2}$, $Mg^{+2}$; $Cl^-$, $Br^-$, $I^-$, mesylate, or tosylate; and n is 0–3, preferably 0–2.

Preferred compounds within the scope of the formula I include those having linking moieties A and A' which are each independently, an ester, an ether, a thio, a polyalkylene oxide, an amido, an ammonium and mixtures thereof;

L and L' are each independently a $C_{1-25}$ straight chain or branched alkylene or unsubstituted arylene; and $Z^2$ is a hydrogen, carboxylic acid, hydroxyl, a phosphate, a sulfonyl, a sulfate, an ammonium, a polyalkylene oxide, or a carbohydrate, preferably unsubstituted. G groups which are preferred include $H^+$, $Li^+$, $Na^+$, $NH^+_4$, $Cl^-$, $Br^-$ or tosylate.

Most preferred compounds which the scope of formula I include those compounds wherein A and A' are each independently an ester ether, an amido, a polyalkylene oxide and mixtures thereof, L and L' are each independently a $C_{1-20}$ straight chain or branched alkylene or an unsubstituted phenylene, $Z^2$ is a hydrogen, a phosphato, a sulfonyl, a carboxylic acid, a sulfate, a polyalkylene oxide and mixtures thereof; and G is $H^+$, $Na^+$ or $NH_4^+$.

Non-limiting examples of compounds within the scope of formula I include the following:

| Perhalogenated Surfactants |
|---|
| $CF_3(CF_2)_aCH_2CH_2C(O)OX$ |
| $CF_3(CF_2)_aCH_2C(O)OX$ |
| $CF_3(CF_2)_aC(O)OX$ |
| $CF_3(CF_2)_aCH_2CH_2C(O)O(CH_2)_mCH_3$ |
| $CF_3(CF_2)_aCH_2C(O)O(CH_2)_mCH_3$ |
| $CF_3(CF_2)_aC(O)O(CH_2)_mCH_3$ |
| $CF_3(CF_2)_aCH_2CH_2P(O)(OH)_2$ |
| $CF_3(CF_2)_aCH_2P(O)(OH)_2$ |
| $CF_3(CF_2)_aOP(O)(OH)_2$ |
| $[CF_3(CF_2)_aCH_2CH_2O]_2P(O)(OH)$ |
| $[CF_3(CF_2)_aCH_2O]_2P(O)(OH)$ |
| $[CF_3(CF_2)_aO]_2P(O)(OH)$ |
| $CF_3(CF_2)_aCH_2CH_2SO_3G$ |
| $CF_3(CF_2)_aCH_2SO_3G$ |
| $CF_3(CF_2)_aSO_3G$ |
| $CF_3(CF_2)_aCH_2CH_2C(O)(CH_2)_mCH_3$ |
| $CF_3(CF_2)_aCH_2C(O)(CH_2)_mCH_3$ |
| $CF_3(CF_2)_aC(O)(CH_2)_mCH_3$ |
| $CF_3(CF_2)_aCH_2CH_2O(CH_2)_mCH_3$ |
| $CF_3(CF_2)_aCH_2O(CH_2)_mCH_3$ |
| $CF_3(CF_2)_aO(CH_2)_mCH_3$ |
| $CF_3(CF_2)_aCH_2CH_2C(O)N[(CH_2)_mCH_3]_2$ |
| $CF_3(CF_2)_aCH_2C(O)N[(CH_2)_mCH_3]_2$ |
| $CF_3(CF_2)_aC(O)N[(CH_2)_mCH_3]_2$ |
| $CF_3(CF_2)_aCH_2CH_2Si(CH_2)_mC(O)OG$ |
| $CF_3(CF_2)_aCH_2Si(CH_2)_mC(O)OG$ |
| $CF_3(CF_2)_aSi(CH_2)_mC(O)OG$ |
| $CF_3(CF_2)_aCH_2CH_2C(O)OCH_2CH_2[OCH_2CH(CH_3)]_pOH$ |
| $CF_3(CF_2)_aCH_2C(O)OCH_2CH_2[OCH_2CH(CH_3)]_pOH$ |
| $CF_3(CF_2)_aC(O)OCH_2CH_2[OCH_2CH(CH_3)]_pOH$ |
| $CF_3(CF_2)_aCH_2CH_2C(O)OCH_2CH_2[OCH_2CH_2]_pOH$ |
| $CF_3(CF_2)_aCH_2C(O)OCH_2CH_2[OCH_2CH_2]_pOH$ |
| $CF_3(CF_2)_aC(O)OCH_2CH_2[OCH_2CH_2]_pOH$ |
| $CF_3(CF_2)_aCH_2CH_2C(O)OCH_2CH_2OCH_2CH(OH)CH_2OH$ |
| $CF_3(CF_2)_aCH_2C(O)OCH_2CH_2OCH_2CH(OH)CH_2OH$ |
| $CF_3(CF_2)_aC(O)OCH_2CH_2OCH_2CH(OH)CH_2OH$ |
| $CF_3(CF_2)_aCH_2CH_2O(CH_2)_aC(O)O(CH_2)_mCH_3$ |
| $CF_3(CF_2)_aCH_2O(CH_2)_aC(O)O(CH_2)_mCH_3$ |
| $CF_3(CF_2)_aO(CH_2)_aC(O)O(CH_2)_mCH_3$ |
| $CF_3(CF_2)_aCH_2CH_2S(CH_2)_aC(O)O(CH_2)_mCH_3$ |
| $CF_3(CF_2)_aCH_2S(CH_2)_aC(O)O(CH_2)_mCH_3$ |
| $CF_3(CF_2)_aS(CH_2)_aC(O)O(CH_2)_mCH_3$ |
| $CF_3(CF_2)_aCH_2CH_2O(CH_2)_a(OCH_2CH_2)_pOH$ |
| $CF_3(CF_2)_aCH_2O(CH_2)_a(OCH_2CH_2)_pOH$ |
| $CF_3(CF_2)_aO(CH_2)_a(OCH_2CH_2)_pOH$ |
| $CF_3(CF_2)_aCH_2CH_2O(CH_2)_a(OCH_2CH(CH_2))_pOH$ |
| $CF_3(CF_2)_aCH_2O(CH_2)_a(OCH_2CH(CH_2))_pOH$ |
| $CF_3(CF_2)_aO(CH_2)_a(OCH_2CH(CH_2))_pOH$ |
| $CF_3(CF_2)_aCH_2CH_2C(O)O(CH_2)_a(OCH_2CH_2)_pOH$ |
| $CF_3(CF_2)_aCH_2C(O)O(CH_2)_a(OCH_2CH_2)_pOH$ |
| $CF_3(CF_2)_aC(O)O(CH_2)_a(OCH_2CH_2)_pOH$ |
| $CF_3(CF_2)_aCH_2CH_2C(O)O(CH_2)_a(OCH_2CH(CH_3))_pOH$ |
| $CF_3(CF_2)_aCH_2C(O)O(CH_2)_a(OCH_2CH(CH_3))_pOH$ |
| $CF_3(CF_2)_aC(O)O(CH_2)_a(OCH_2CH(CH_3))_pOH$ |
| $CF_3(CF_2)_aCH_2CH_2OCH_2CH_2OCH_2CH(OH)CH_2OH$ |
| $CF_3(CF_2)_aCH_2OCH_2CH_2OCH_2CH(OH)CH_2OH$ |
| $CF_3(CF_2)_aOCH_2CH_2OCH_2CH(OH)CH_2OH$ |
| $[CF_3(CF_2)_aCH_2CH_2C(O)OCH_2]_2N(CH_2)_mCOOX$ |
| $[CF_3(CF_2)_aCH_2C(O)OCH_2]_2N(CH_2)_mCOOX$ |
| $[CF_3(CF_2)_aC(O)OCH_2]_2N(CH_2)_mCOOX$ |
| $[CF_3(CF_2)_aCH_2CH_2C(O)OCH_2]_2CH(CH_2)_mCOOX$ |
| $[CF_3(CF_2)_aCH_2C(O)OCH_2]_2CH(CH_2)_mCOOX$ |
| $[CF_3(CF_2)_aC(O)OCH_2]_2CH(CH_2)_mCOOX$ |
| $CF_3(CF_2)_aCH_2CH_2S(CH_2)_aC(O)N[(CH_2)_mCH_3]_2$ |
| $CF_3(CF_2)_aCH_2S(CH_2)_aC(O)N[(CH_2)_mCH_3]_2$ |
| $CF_3(CF_2)_aS(CH_2)_aC(O)N[(CH_2)_mCH_3]_2$ |
| $CF_3(CF_2)_aCH_2CH_2O(CH_2)_aC(O)N[(CH_2)_mCH_3]_2$ |
| $CF_3(CF_2)_aCH_2O(CH_2)_aC(O)N[(CH_2)_mCH_3]_2$ |
| $CF_3(CF_2)_aO(CH_2)_aC(O)N[(CH_2)_mCH_3]_2$ |
| $CH_2C(O)O(CF_2)_aCF_3$ <br> \| <br> $CH(SO_3G)C(O)O(CF_2)_aCF_2$ |

-continued

Perhalogenated Surfactants $CH(SO_3G)C(O)OCH_2CH_2(CF_2)_aCF_3$
|
$CH_2C(O)OCH_2CH_2(CF_2)_aCF_3$ $CH_2C(O)OCH_2(CF_2)_aCF_3$
|
$CH(SO_3G)C(O)OCH_2(CF_2)_aCF_3$

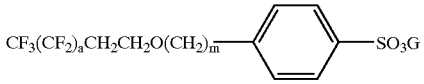

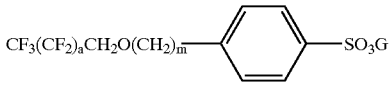

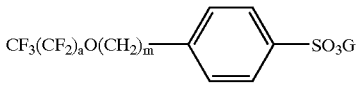

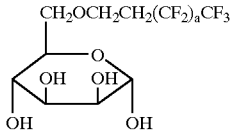

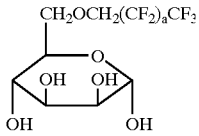

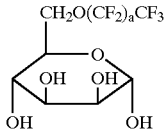

$CF_3(CF_2)_aCH_2CH_2C(O)(CH_2)_mN(CH_3)_3G$
$CF_3(CF_2)_aCH_2C(O)(CH_2)_mN(CH_3)_3G$
$CF_3(CF_2)_aC(O)(CH_2)_mN(CH_3)_3G$
$CClF_2(CClF)_aCH_2CH_2C(O)OX$
$CClF_2(CClF)_aCH_2C(O)OX$
$CClF_2(CClF)_aC(O)OX$
$CClF_2(CClF)_aCH_2CH_2CH_2C(O)O(CH_2)_mCH_3$
$CClF_2(CClF)_aCH_2CH_2C(O)O(CH_2)_mCH_3$
$CClF_2(CClF)_aCH_2C(O)O(CH_2)_mCH_3$
$CClF_2(CClF)_aCH_2CH_2OP(O)(OH)_2$
$CClF_2(CClF)_aCH_2OP(O)(OH)_2$
$CClF_2(CClF)_aOP(O)(OH)_2$
$[CClF_2(CClF)_aCH_2CH_2O]_2P(O)(OH)$
$[CClF_2(CClF)_aCH_2O]_2P(O)(OH)$
$[CClF_2(CClF)_aO]_2P(O)(OH)$
$CClF_2(CClF)_aCH_2CH_2SO_3G$
$CClF_2(CClF)_aCH_2SO_3G$
$CClF_2(CClF)_aSO_3G$
$CClF_2(CClF)_aCH_2CH_2C(O)(CH_2)_mCH_3$
$CClF_2(CClF)_aCH_2C(O)(CH_2)_mCH_3$
$CClF_2(CClF)_aC(O)(CH_2)_mCH_3$
$CClF_2(CClF)_aCH_2CH_2S(CH_2)_{a'}C(O)O(CH_2)_mCH_3$
$CClF_2(CClF)_aCH_2S(CH_2)_{a'}C(O)O(CH_2)_mCH_3$
$CClF_2(CClF)_aS(CH_2)_{a'}C(O)O(CH_2)_mCH_3$
$CClF_2(CClF)_aCH_2CH_2O(CH_2)_{a'}(OCH_2CH_2)_pOH$
$CClF_2(CClF)_aCH_2O(CH_2)_{a'}(OCH_2CH_2)_pOH$
$CClF_2(CClF)_aO(CH_2)_{a'}(OCH_2CH_2)_pOH$
$CClF_2(CClF)_aCH_2CH_2O(CH_2)_{a'}(OCH_2CH(CH_3))_pOH$
$CClF_2(CClF)_aCH_2O(CH_2)_{a'}(OCH_2CH(CH_3))_pOH$
$CClF_2(CClF)_aO(CH_2)_{a'}(OCH_2CH(CH_3))_pOH$
$CClF_2(CClF)_aCH_2CH_2C(O)(CH_2)_mN(CH_3)_3G$

-continued

Perhalogenated Surfactants $CClF_2(CClF)_aCH_2C(O)(CH_2)_mN(CH_3)_3G$
$CClF_2(CClF)_aC(O)(CH_2)_mN(CH_3)_3G$
$CClF_2(CClF)_aCH_2CH_2O(CH_2)_mCH_3$
$CClF_2(CClF)_aCH_2O(CH_2)_mCH_3$
$CClF_2(CClF)_aO(CH_2)_mCH_3$
$CClF_2(CClF)_aCH_2CH_2C(O)N[(CH_2)_mCH_3]_2$
$CClF_2(CClF)_aCH_2C(O)N[(CH_2)_mCH_3]_2$
$CClF_2(CClF)_aC(O)N[(CH_2)_mCH_3]_2$ a = 1–30
a' = 1–20
m = 1–30
p = 1–50
G = $H^+$, $Na^-$, $K^+$, $NH_4^+$, $Mg^{+2}$, $Ca^{+2}$, $Li^+$, $Cl^-$, Br, OTs, OMs, etc.

Compounds of formula I are prepared by any conventional preparation method known in the art such as the one described in March. J., "Advanced Organic Chemistry", J. Wiley & Sons, N.Y. (1985).

Commercially available fluoridated compounds include compounds supplied as the Zonyl™ series by Dupont.

The second group of surfactants useful in the dry cleaning system are those compounds having a polyalkylene oxide moiety and having a formula (II):

(II)

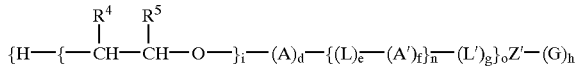

wherein $R^4$ and $R^5$ each represent a hydrogen, a $C_{1-5}$ straight chained or branched alkylene or alkylene oxide and mixtures thereof.

is 1 to 50 preferably 1 to 30; and

A, A', d, L, L', e f, n, g, o, $Z^2$, G and h are as defined above.

Preferably $R^4$ and $R^5$ are each independently a hydrogen, a $C_{1-3}$ alkylene, or alkylene oxide and mixtures thereof.

Most preferably $R^4$ and $R^5$ are each independently a hydrogen, $C_{1-3}$ alkylene and mixtures thereof. Non-limiting examples of compounds within the scope of formula II are:

Polypropylene Glycol Surfactants $HO(CH_2CH(CH_3)O)_i(CH_2CH_2O)_iH$
$HO(CH(CH_3)CH_2O)_i(CH_2CH_2O)_iH$
$HO(CH_2CH(CH_3)O)_i(CH_2CH_2O)_i(CH_2CH(CH_2)O)_kH$
$HO(CH(CH_3)CH_2O)_i(CH_2CH_2O)_i(CH_2CH(CH_2)O)_kH$
$HO(CH_2CH(CH_3)O)_i(CH_2CH_2O)_i(CH(CH_3)CH_2O)_kH$
$HO(CH(CH_3)CH_2O)_i(CH_2CH_2O)_i(CH(CH_3)CH_2O)_kH$
$HO(CH_2CH_2O)_i(CH_2CH(CH_3)O)_j(CH_2CH_2O)_kH$
$HO(CH_2CH_2O)_i(CH(CH_3)CH_2O)_j(CH_2CH_2O)_kH$
$HO(CH(CH_3)CH_2O)_iC(O)(CH_2)_mCH_3$
$HO(CH_2CH(CH_3)O)_iC(O)(CH_2)_mCH_3$
$HO(CH(CH_3)CH_2O)_i(CH_2)_mCH_3$
$HO(CH_2CH(CH_3)O)_i(CH_2)_mCH_3$
$HO(CH(CH_3)CH_2O)_iC(O)O_jCH_2)_mCH_3$
$HO(CH_2CH(CH_3)O)_iC(O)O_jCH_2)_mCH_3$
$HO(CH(CH_3)CH_2O)_iC(O)N[(CH_2)_mCH_3]_2$
$HO(CH_2CH(CH_3)O)_iC(O)N[(CH_2)_mCH_3]_2$
$HO(CH(CH_3)CH_2O)_iC(O)(CH_2)_mCOOG$
$HO(CH_2CH(CH_3)O)_iC(O)(CH_2)_mCOOG$
$HO(CH(CH_3)CH_2O)_i(CH_2)_mCOOG$
$HO(CH_2CH(CH_3)O)_i(CH_2)_mCOOG$
$HO(CH(CH_3)CH_2O)_iC(O)C(CH_2)_mCOOG$
$HO(CH_2CH(CH_3)O)_iC(O)C(CH_2)_mCOOG$
$HO(CH(CH_3)CH_2O)_iC(O)N[(CH_2)_mCOOG]_2$ -continued

| Polypropylene Glycol Surfactants |
|---|
| $HO(CH_2CH(CH_3)O)_iC(O)N[(CH_2)_mCOOG]_2$ |
| $HO(CH(CH_3)CH_2O)_iC(O)(CH_2)_mSO_3G$ |
| $HO(CH_2CH(CH_3)O)_iC(O)(CH_2)_mSO_3G$ |
| $HO(CH(CH_3)CH_2O)_i(CH_2)_mSO_3G$ |
| $HO(CH_2CH(CH_3)O)_i(CH_2)_mSO_3G$ |
| $HO(CH(CH_3)CH_2O)_iC(O)CH_2CH_2OCH_2CH(OH)CH_2OH$ |
| $HO(CH_2CH(CH_3)O)_iC(O)CH_2CH_2OCH_2CH(OH)CH_2OH$ |
| $HO(CH(CH_3)CH_2O)_iCH_2CH_2OCH_2CH(OH)CH_2OH$ |
| $HO(CH_2CH(CH_3)O)_iCH_2CH_2OCH_2CH(OH)CH_2OH$ |
| $HO(CH(CH_3)CH_2O)_iC(O)(CH_2)_mN(CH_3)_3G$ |
| $HO(CH_2CH(CH_3)O)_iC(O)(CH_2)_mN(CH_3)_3G$ |
| $HO(CH(CH_3)CH_2O)_i(CH_2)_mN(CH_3)_3G$ |
| $HO(CH_2CH(CH_3)O)_i(CH_2)_mN(CH_3)_3G$ |
| $HO(CH(CH_3)CH_2O)_iC(O)O(CH_2)_mN(CH_3)_3G$ |
| $HO(CH_2CH(CH_3)O)_iC(O)O(CH_2)_mN(CH_3)_3G$ |
| 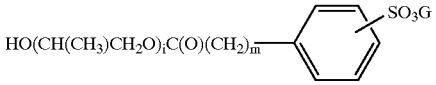 |
| 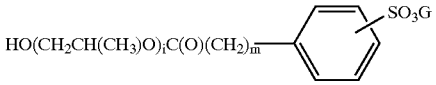 |
| 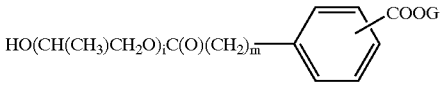 |
| 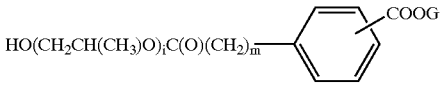 |
| $CH_2C(O)C(CH(CH_3)CH_2O)_iH$ / $CH_2(SO_3C)C(O)C(CH_2CH(CH_3)O)_iH$ |
| $CH_2C(O)C(CH_2CH(CH_3)O)_iH$ / $CH_2(SO_3C)C(O)C(CH(CH_3)CH_2O)_iH$ |
| $CH_2C(O)N[(CH(CH_3)CH_2O)_iH]_2$ / $CH_2(SO_3O)C(O)N[(CH_2CH(CH_3)C)_iH]_2$ |
| $CH_2C(O)N[(CH_2CH(CH_3)O)_iH]_2$ / $CH_2(SO_3C)C(O)N[(CH(CH_3)CH_2O)_iH]_2$ |
| 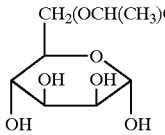 |
| 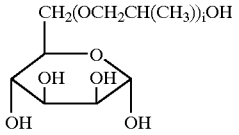 |

i = 1–50, j = 1–50, k = 1–50, m = 1–30.
G = $H^+$, $Na^-$, $K^+$, $NH_4^-$, $Ca^{-2}$, $Mg^{-1}$, $Cl^-$, Br, OTs, OMs, etc.

Compounds of formula II may be prepared as is known in the art and as described in March et al., Supra.

Examples of commercially available compounds of formula II may be obtained as the Pluronic series from BASF, Inc.

A third group of surfactants useful in the invention contain a halogenated polyalkylene oxide moiety and the compounds have a formula:

$$[(CX_3(XO)_r(T)_s)_c(A)_d=[(L)_e=(A')_f=]_n(L')_g]_oZ^2(G)_h \quad \text{(III)}$$

wherein XO is a halogenated alkylene oxide having $C_{1-6}$ straight or branched halocarbons, preferably $C_{1-3}$.

r is 1–50, preferably 1–25, most preferably 5–20.

T is a straight chained or branched halogphenylene or haloalkylene.

s is 0 to 5, preferably 0–3.

X, A, A', c, d, L, L', e, f, n, g, o, $Z^2$, G and h are as defined above.

Non-limiting examples of halogenated polyalkylene oxide containing compounds include:

| Perhaloether Surfactants |
|---|
| $CF_3(CF_2CF_2O)_r(CH_2CH_2O)_rH$ |
| $CF_3(CF_2CF_2O)_r(CH_2CH(CH_3)O)_rH$ |
| $CF_3(CF_2CF(CF_3O)_r(CH_2CH_2O)_rH$ |
| $CF_3(CF_2CF(CF_3O)_r(CH_2CH(CH_3)O)_rH$ |
| $CF_3(CF_2CF_2O)_rP(O)(OH)_2$ |
| $CF_3(CF_2CF_2O)_rCF_2P(O)(OH)_2$ |
| $CF_3(CF_2CF_2O)_rCF(CF_3)P(O)(OH)_2$ |
| $[CF_3(CF_2CF_2O)_r]_2P(O)(OH)$ |
| $[CF_3(CF_2CF_2O)_rCF_2]_2P(O)(OH)$ |
| $[CF_3(CF_2CF_2O)_rCF(CF_3)]_2P(O)(OH)$ |
| $CF_3(CF_2CF_2)O)_rP(O)(OH)_2$ |
| $CF_3(CF_2CF(CF_3)O)_rCF_2P(O)(OH)_2$ |
| $CF_3(CF_2CF(CF_3)O)_rCF(CF_3)P(O)(OH)_2$ |
| $[CF_2(CF_2CF(CF_2)O)_r]_2P(O)(OH)$ |
| $[CF_2(CF_2CF(CF_2)O)_rCF_2]_2P(O)(OH)$ |
| $[CF_2(CF_2CF(CF_2)O)_rCF(CF_3)]_2P(O)(OH)$ |
| $CF_3(CF_2CF_2O)_rC(O)OG$ |
| $CF_3(CF_2CF_2O)_rCF_2C(O)OG$ |
| $CF_3(CF_2CF_2O)_rCF(CF_3)_rC(O)OG$ |
| $CF_3(CF_2CF(CF_3)O)_rC(O)OG$ |
| $CF_3(CF_2CF(CF_3)O)_rCF_2C(O)OG$ |
| $CF_3(CF_2CF(CF_3)O)_rCF(CF_3)C(O)OG$ |
| $CF_3(CF_2CF_2O)_rC(O)C(CH_2)_mCH_3$ |
| $CF_3(CF_2CF_2O)_rCF_2C(O)C(CH_2)_mCH_3$ |
| $CF_3(CF_2CF_2O)_rCF(CF_3)C(O)C(CH_2)_mCH_3$ |
| $CF_3(CF_2CF(CH_3)O)_rC(O)O(CH_2)_mCH_3$ |
| $CF_3(CF_2CF(CH_3)O)_rCF_2C(O)O(CH_2)_mCH_3$ |
| $CF_3(CF_2CF(CH_3)O)_rCF(CF_2)C(O)O(CH_2)_mCH_3$ |
| $CF_3(CF_2CF_2O)_nC(O)OCH_2CH_2OCH_2CH(OH)CH_2OH$ |
| $CF_3(CF_2CF_2O)_nCF_2C(O)OCH_2CH_2OCH_2CH(OH)CH_2OH$ |
| $CF_3(CF_2CF(CF_3)O)_nC(O)OCH_2CH_2OCH_2CH(OH)CH_2OH$ |
| $CF_3(CF_2CF_2O)_rC(O)N[(CH_2)_mCH_3]_2$ |
| $CF_3(CF_2CF_2O)_rCF_2C(O)N[(CH_2)_mCH_3]_2$ |
| $CF_3(CF_2CF_2O)_rCFC(CCF_2)C(O)N[(CH_2)_mCH_3]_2$ |
| $CF_3(CF_2CF(CF_3)O)_rC(O)N[(CH_2)_mCH_3]_2$ |
| $CF_3(CF_2CF(CF_3)O)_rCF_2C(O)N[(CH_2)_mCH_3]_2$ |
| $CF_3(CF_2CF(CF_3)O)_rCF(CF_2)C(O)N[(CH_2)_mCH_3]_2$ |
| $CF_2(CF_2CF_2O)_rC(CH_2)_mCH_3$ |
| $CF_2(CF_2CF_2O)_rCF_2C(CH_2)_mCH_3$ |
| $CF_3(CF_2CF_2O)_rCF(CF_3)O(CH_2)_mCH_3$ |
| $CF_3(CF_2CF(CF_3)O)_rO(CH_2)_mCH_3$ |
| $CF_3(CF_2CF(CF_3)O)_rCF_2O(CH_2)_mCH_3$ |
| $CF_3(CF_2CF(CF_3)O)_rCF(CF_3)O(CH_2)_mCH_3$ |
| $CF_3(CF_2CF_2O)_rC(O)O(CH_2)_mSO_3G$ |
| $CF_3(CF_2CF_2O)_rCF_2C(O)O(CH_2)_mSO_3G$ |
| $CF_3(CF_2CF_2O)_rCF(CF_3)C(O)O(CH_2)_mSO_3G$ |
| $CF_3(CF_2CF(CF_3)O)_rC(O)O(CH_2)_mSO_3G$ |
| $CF_3(C_2CF(CF_3)O)_rCF_2C(O)O(CH_2)_mSO_3G$ |
| $CF_3(CF_2CF(CF_3)O)_rCF(CF_3)C(O)O(CH_2)_mSO_3G$ |
| $CF_3(CF_2CF_2O)_rC(O)O(CH_2)_mCO_2G$ |
| $CF_3(CF_2CF_2O)_rCF_2C(O)O(CH_2)_mCO_2G$ |
| $CF_3(CF_2CF_2O)_rCF(CF_3)C(O)O(CH_2)_mCO_2G$ |
| $CF_3(C_2CF(CF_3)O)_rC(O)9(CH_2)_mCO_2G$ |
| $CF_3(C_2CF(CF_3)O)_rCF_2C(O)O(CH_2)_mCO_2G$ |
| $CF_3(C_2CF(CF_3)O)_rCF(CF_2)C(O)O(CH_2)_mCO_2G$ |
| $CF_3(CF_2CFC_2O)_rC(O)(CH_2)_mCH_3$ |

-continued

Perhaloether Surfactants $CF_3(CF_2CFC_2O)_rCF_2C(O)(CH_2)_mCH_3$
$CF_3(CF_2CFC_2O)_rCF(CF_2)C(O)(CH_2)_mCH_3$
$CF_3(CF_2CF(CF_3)O)_rC(O)(CH_2)_mCH_3$
$CF_3(CF_2CF(CF_3)O)_rCF_2C(O)(CH_2)_mCH_3$
$CF_3(CF_2CF(CF_3)O)_rCF(CF_3)C(O)(CH_2)_mCH_3$
$CF_3(CF_2CF_2O)_rC(O)(CH_2)_mN(CH_3)_3G$
$CF_3(CF_2CF_2O)_rCF_2C(O)(CH_2)_mN(CH_3)_3G$
$CF_3(CF_2CF_2O)_rCCF)CF_3)C(O)(CH_2)_mN(CH_3)_3G$
$CF_3(CF_2CF(CF_2)O)_rC(O)(CH_2)_mN(CH_3)_3G$
$CF_3(CF_2CF(CF_2)O)_rCF_2C(O)(CH_2)_mN(CH_3)_3G$
$CF_3(CF_2CF(CF_2)O)_rCF(CF_2)C(O)(CH_2)_mN(CH_3)_3G$

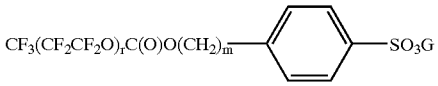

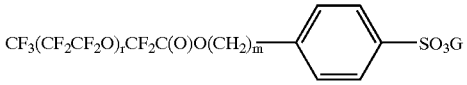

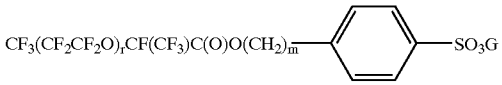

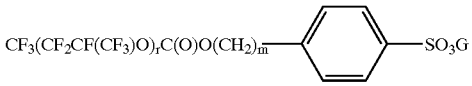

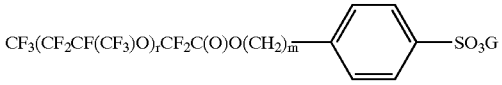

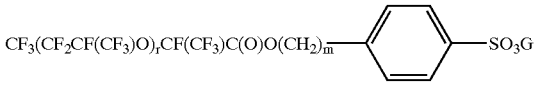

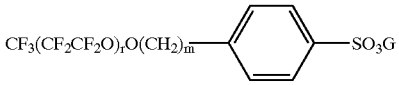

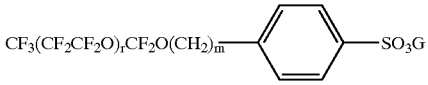

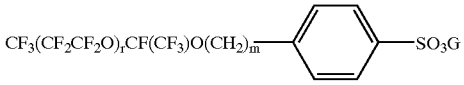

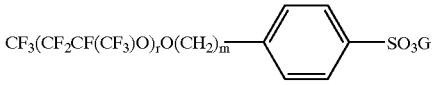

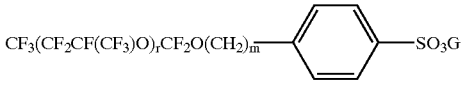

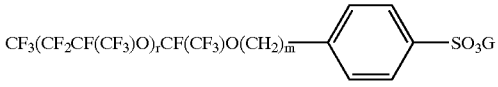

$CH_2OC(O)(CF_2CF_2O)_rCF_3$
|
$CH(SO_3G)OC(O)(CF_2CF_2O)_rCF_3$

-continued

Perhaloether Surfactants $CH_2OC(O)CF_2(CF_2CF_2O)_rCF_3$
|
$CH(SO_3G)OC(O)CF_2(CF_2CF_2O)_rCF_2$ $CH_2OC(O)CF(CF_3)(CF_2CF_2O)_rCF_3$
|
$CH(SO_3G)OC(O)CF(CF_3)(CF_2CF_2O)_rCF_3$ $CH_2OC(O)(CF_2CF(CF_3)O)_rCF_3$
|
$CH(SO_3G)OC(O)(CF_2CF(CF_3)O)_rCF_2$ $CH_2OC(O)CF_2(CF_2CF(CF_3)O)_rCF_3$
|
$CH(SO_3G)OC(O)CF_2(CF_2CF(CF_3)O)_rCF_3$ $CH_2OC(O)CF(CF_3)(CF_2CF(CF_3)O)_rCF_3$
|
$CH(SO_3G)OC(O)CF(CF_3)(CF_2CF(CF_3)O)_rC$ $CClF_2(CClFCClFO)_r(CH_2CH_2O)_tH$
$CClF_2(CClFCClFO)_r(CH_2CH(CH_3)O)_tH$
$CClF_2(CClFCF(CClF_2)O)_r(CH_2CH_2O)_tH$
$CClF_2(CClFCF(CClF_2)O)_r(CH_2CH(CH_3)O)_tH$
$CClF_2(CClFCClFO)_rP(O)(OH)_2$
$CClF_2(CClFCClFO)_rCF_2P(O)(OH)_2$
$CClF_2(CClFCClFO)_rCF(CF_3P(O)(OH)_2$
$[CClF_2(CClFCClFO)_r]_2P(O)(OH)$
$[CClF_2(CClFCClFO)_rCF_2]_2P(O)(OH)$
$[CClF_2(CClFCClFO)_rCF(CF_3)]_2P(O)(OH)$
$CClF_2(CClFCF(CClF_2)_O)_rP(O)(OH)_2$
$CClF_2(CClFCF(CClF_2)O)_rCF_2P(O)(OH)_2$
$CClF_2(CClFCF(CClF_2)O)_rCF_2(CF_3)P(O)(OH)_2$
$[CClF_2(CClFCF(CClF_2)O)_r]_2P(O)(OH)$
$[CClF_2(CClFCF(CClF_2)O)_rCF_2]_2P(O)(OH)$
$[CClF_2(CClFCF)CClF_2)O)CF(CF_3)]_2P(O)(OH)$
$CClF_2(CClFCClFO)_rC(O)OG$
$CClF_2(CClFCClFO)_rCF_2C(O)OG$
$CClF_2(CClFCClFO)_rCF(CF_3)C(O)OG$
$CClF_2(CClFCF(CClF_2)O)_rC(O)OG$
$CClF_2(CClFCF(CClF_2)O)_rCF_2C(O)OG$
$CClF_2(CClFCF(CClF_2)O)_rCF(CF_3)C(O)OG$ r = 1–30
t = 1–40
m = 1–30
G = $H^+$, $Na^-$, $Li^+$, $K^-$, $NH_4^-$, $Ca^{-2}$, $Mg^{-2}$, $Cl^-$, Br, OTs, OMs, etc.

Examples of commercially available compounds within the scope of formula III include those compounds supplied under the Krytox™ series by DuPont having a formula:

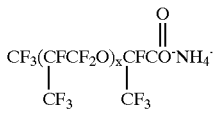

wherein x is 1–50.

Other compounds within the scope of formula III are made as known in the art and described in March et al., Supra.

The fourth group of surfactants useful in the invention include siloxanes containing surfactants of formula IV $$MD_xD^*_yM \quad (IV)$$

wherein M is a trimethylsiloxyl end group. $D_x$ is a dimethylsiloxyl backbone which is $CO_2$-philic and $D^*_y$ is one or more methylsiloxyl groups which are substituted with a $CO_2$-phobic $R^2$ or $R^3$ group.

wherein $R^2$ and $R^3$ each independently have the following formula:

$$(CH_2)_a(C_6H_4)_b(A)_d—[(L)_e—(A')_f—]_n—(L')_gZ^2(G)_h$$

wherein a is 1–30, preferably 1–25, most preferably 1–20, b is 0 or 1, $C_5H_4$ is unsubstituted or substituted with a $C_{1-10}$ alkylene or alkenylene, and A, A', d, L, e, f, n, L', g, $Z^2$, G and h are as defined above and mixtures of $R^2$ and $R^3$ thereof.

The $D_x$:$D^*_y$ ratio of the siloxane containing surfactants should be greater than 0.5:1. preferably greater than 0.7:1 and most preferably greater than 1:1.

The siloxane compounds should have a molecular weight ranging from 100 to 100,000. preferably 200 to 50,000, most preferably 500 to 35,000.

Silicones may be prepared by any conventional method such as the method described in Hardman, B. "Silicones" the *Encyclopedia of Polymer Science and Engineering,* v. 15, 2nd Ed., J. Wiley and Sons, NY, N.Y. (1989).

Examples of commercially available siloxane containing compounds which may be used in the invention are those supplied under the ABIL series by Goldschmidt.

Suitable siloxane compounds within the scope of formula IV are compounds of formula V:

(V)

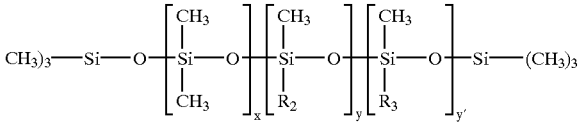

the ratio of x:y and y' is greater than 0.5:1, preferably greater than 0.7:1 and most preferably greater than 1:1, and $R^2$ and $R^3$ are as defined above.

Preferred $CO_2$-phobic groups represented by $R^2$ and $R^3$ include those moieties of the following formula:

$$(CH_2)_a(C_6H_4)_b(A)_d—[(L)_e—(A')_f—]—(L')_gZ^2(G)_h$$

wherein a is 1–20.

b is 0.

$C_6H_4$ is unsubstituted.

A, A', d, L, e, f, n, g, $Z^2$, G and h are as defined above. and mixtures of $R^2$ and $R^3$.

Non-limiting examples of polydimethylsiloxane surfactants substituted with $CO_2$-phobic $R^2$ and $R^3$ groups are:

Polydimethylsiloxane Surfactants

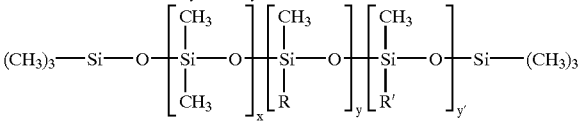

x = 1–300; y = 1–100; y' = 1–100

R or R' = $(CH_2)_aCH_3$
= $(CH_2)_aCH{=}CH(CH_2)_mCH_3$
= $(CH_2)_aO(CH_2)_mCH_3$
= $(CH_2)_aS(CH_2)_mCH_3$
= $(CH_2)_aN[(CH_2)_mCH_3]_2$
= $(CH_2)_aC(O)O(CH_2)_mCH_3$
= $(CH_2)_aC(O)(CH_2)_mCH_3$
= $(CH_2)_4C(O)N[(CH_2)_MCH_3]_2$

-continued

Polydimethylsiloxane Surfactants

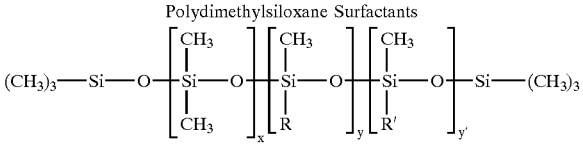

x = 1–300; y = 1–100; y' = 1–100

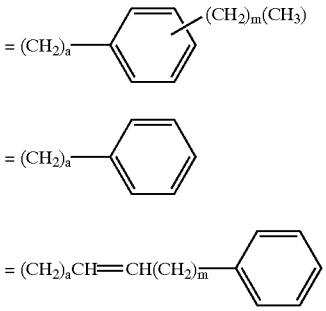

= $(CH_2)_a(CH_2CH_2O)_pH$
= $(CH_2)_a(CH_2CH_2O)_pCH_3$
= $(CH_2)_a(CH_2CH_2O)_p(CH_2)_mCH_3$
= $(CH_2)_a(CH_2CH(CH_3)O)_pH$
= $(CH_2)_a(CH_2CH(CH_3)O)_pCH_3$
= $(CH_2)_a(CH_2CH(CH_3)O)_p(CH_2)_mCH_3$
= $(CH_2)_aCOOG$
= $(CH_2)_aSO_3G$
= $(CH_2)_aOP(O)(OG)_2$
= $[(CH_2)_aO]P(O)(O(CH_2)_mCH_3)(OG)$
= $(CH_2)_aO(CH_2)_mCOOG$
= $(CH_2)_aS(CH_2)_mCOOG$
= $(CH_2)_aN[(CH_2)_mCOOG]_2$
= $(CH_2)_aO(CH_2)_mSO_2G$
= $(CH_2)_aS(CH_2)_mSO_3G$
= $(CH_2)_aN[(CH_2)_mSO_3G]_2$
= $(CH_2)_aO(CH_2)_mOP(O)(OG)_2$
= $(CH_2)_aS(CH_2)_mOP(O)(OG)_2$
= $(CH_2)_aO(CH_2)_mN(CH_3)_3G$
= $(CH_2)_aO(CH_2)_mN(CH_3)_3G$
= $(CH_2)_aOCH_2CH(OH)OH_2OH$
= $(CH_2)_a(OCH_2CH_2)_p(OCH_2CH(CH_3))_pOH$
= $(CH_2)_a(OCH_2CH_2)_p(OCH(CH_3CH_2)_pOH$
= $(CH_2)_a(OCH_2CH_2)_p(CH_2)_mCOOG$
= $(CH_2)_a(OCH_2CH_2)_p(CH_2)_mSO_3G$

R

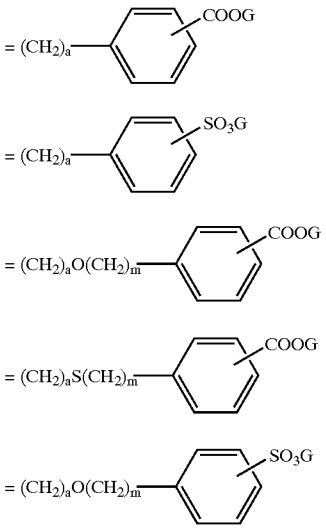

-continued

Polydimethylsiloxane Surfactants

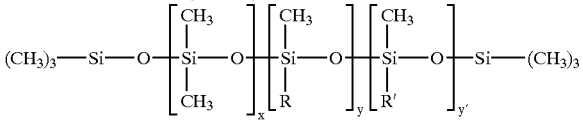

x = 1–300; y = 1–100; y′ = 1–100

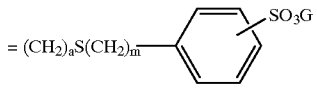

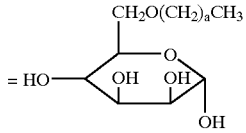

Enzymes

Enzymes may additionally be added to the dry cleaning system of the invention to improve stain removal. Such enzymes include proteases (e.g., Alcalase[7], Savinase[7] and Esperase[7] from Novo Industries A/S); amylases (e.g., Termamyl[7] and Duramyl[7] bleach resistant amylases from Novo Industries A/S); lipases (e.g., Lipolase[7] from Novo Industries A/S); and oxidases. The enzyme should be added to the cleaning drum in an amount from 0.001% to 10%, preferably 0.01% to 5%. The type of soil dictates the choice of enzyme used in the system. The enzymes should be delivered in a conventional manner, such as by preparing an enzyme solution, typically of 1% by volume (i.e., 3 mls enzyme in buffered water or solvent).

Modifiers

In a preferred embodiment, a modifier such as water, or an organic solvent may be added to the cleaning drum in a small volume. Water is specifically added into the drum in addition to any water absorbed onto the fabrics to be drycleaned or any water which may be introduced in a residual amount with the surfactant from the surfactant production process. Preferred amounts of modifier should be 0.1% to about 10% by volume, more preferably 0.1% to about 5% by volume, most preferably 0.1% to about 3%. Preferred solvents include acetone, glycols, acetonitrile, $C_{1-10}$ alcohols and $C_{5-15}$ hydrocarbons. Especially preferred modifiers include water, ethanol, methanol and hexane.

Peracid Precursors

Organic peracids which are stable in storage and which solubilize in densified carbon dioxide are effective at bleaching stains in the dry cleaning system. The selected organic peracid should be soluble in carbon dioxide to greater than 0.001 wt. % at pressures of about 14.7 to about 10,000 psi and temperatures of about −78.5° C. to about 100° C. The peracid compound should be present in an amount of about 0.01% to about 5%, preferably 0.1% to about 3%.

The organic peroxyacids usable in the present invention can contain either one or two peroxy groups and can be either aliphatic or aromatic. When the organic peroxy acid is aliphatic, the unsubstituted acid has the general formula:

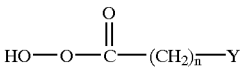

where Y can be, for example, H, $CH_3$, $CH_2Cl$, COOH, or COOOH; and n is an integer from 1 to 20.

When the organic peroxy acid is aromatic, the unsubstituted acid has the general formula:

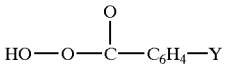

wherein Y is hydrogen, alkylene, alkylenehalogen, halogen, or COOH or COOOH.

Typical monoperoxyacids useful herein include alkylene peroxyacids and arylene peroxyacids such as;

(i) peroxybenzoic acid and ring-substituted peroxybenzoic acid, e.g. peroxy-"-naphthoic acid;

(ii) aliphatic, substituted aliphatic and arylenealkylene monoperoxy acids, e.g. peroxylauric acid, peroxystearic acid, and N,N-phthaloylaminoperoxycaproic acid (PAP); and (iii) amidoperoxy acids, e.g. monononylamide of either peroxysuccinic acid (NAPSA) or of peroxyadipic acid (NAPAA)

Typical diperoxy acid useful herein include alkylene diperoxy acids and arylenediperoxy acids, such as:

(iii) 1,12-diperoxydodecanedioic acid;

(iv) 1,9-diperoxyazelaic acid;

(v) diperoxybrassylic,acid; diperoxysebacic acid and diperoxyisophthalic acid;

(vi) 2-decyldiperoxybutane-1,4-dioic acid;

(vii) 4,4'-sulfonylbisperoxybenzoic acid; and (viii) N,N'-terephthaloyl-di(6-aminoperoxycaproic acid) (TPCAP).

Particularly preferred peroxy acids include PAP, TPCAP, haloperbenzoic acid and peracetic acid.

Dry Cleaning Process

A process of dry cleaning using densified carbon dioxide as the cleaning fluid is schematically represented in FIG. 1. A cleaning vessel 5, preferably a rotatable drum, receives soiled fabrics as well as the selected surfactant, modifier, enzyme, peracid and mixtures thereof. The cleaning vessel may also be referred to as an autoclave, particularly as described in the examples below.

Densified carbon dioxide is introduced into the cleaning vessel from a storage vessel 1. Since much of the $CO_2$ cleaning fluid is recycled within the system, any losses during the dry cleaning process are made up through a $CO_2$ supply vessel 2. The $CO_2$ fluid is pumped into the cleaning vessel by a pump 3 at pressures ranging between about 14.7 and about 10,000 psi, preferably about 75.1 to about 7000 psi, most preferably about 300 psi to about 6000 psi. The $CO_2$ fluid is maintained at temperatures of about −78.5° C. to about 100° C. preferably about −56.2° C. to about 60° C. most preferably about 0° C. to about 60° C. by a heat exchanger 4, or by pumping a cooling solution through an internal condenser.

As an example of the operation of the system, the densified $CO_2$ is transferred from the supply vessel 2 to the cleaning vessel 5 through line 7 for a dry cleaning cycle of between about 15 to about 30 minutes. Before or during the cleaning cycle, surfactants, modifiers, enzymes, peracid and mixtures thereof as discussed above are introduced into the cleaning vessel, preferably through a line and pump system connected to the cleaning vessel.

At the end of the dry cleaning cycle, dirty $CO_2$ soil and spent cleaning agents are transferred through an expansion valve 6, a heat exchanger 8 by way of a line 9 into a flash drum 10. In the flash drum, pressures are reduced to between about 260 and about 1,000 psi and to a temperature of about −23° C. to about 60° C. Gaseous $CO_2$ is separated from the soil and spent agents and transferred via line 11 through a filter 12 and condenser 13 to be recycled back to the supply vessel 2. Any pressure losses are recovered by using pump 16. The spent agents and residue $CO_2$ are transferred via line 14 to an atmospheric tank 15, where the remaining $CO_2$ is vented to the atmosphere.

Other processes known in the art may be used in the claimed dry cleaning system such as those in Dewees et al., U.S. Pat. No. 5,267,455, owned by The Clorox Company and JP 08052297 owned by Hughes Aircraft Co., herein incorporated by reference.

The following examples will more fully illustrate the embodiments of the invention. All parts, percentages and proportions referred to herein and in appended claims are by weight unless otherwise indicated. The definition and examples are intended to illustrate and not limit the scope of the invention.

EXAMPLE 1

Hydrocarbon and fluorocarbon containing surfactants useful in the invention must exhibit a hydrophilic/lipophilic balance of less than 15. This example describes the calculation of HLB values for various surfactants to determine their effectiveness in supercritical carbon dioxide. This calculation for various hydrocarbon and fluorocarbon surfactants is reported in the literature[1] and is represented by the following equation:

HLB=7+G(hydrophilic group numbers)−E(lipophilic group numbers)

The hydrophilic and lipophilic group numbers have been assigned to a number of common surfactant functionalities including hydrophilic groups such as carboxylates, sulfates and ethoxylates and lipophilic groups such as —$CH_2$, $CF_2$ and PPG's.[1] These group numbers for the functional groups in surfactants were utilized to calculate the HLB number for the following hydrocarbon or fluorocarbon surfactant:

The conventional surfactants (Nos. 14–18) exhibit an HLB value of greater than 15 and are not effective as dry cleaning components in the invention.

EXAMPLE 2

Supercritical fluid carbon dioxide only as a cleaning medium was used to dry clean several hydrophobic stains on cotton and wool fabrics.

The stained fabrics were prepared by taking a two inch by three inch cloth and applying the stain directly to the cloths. The cloths were allowed to dry.

The stained fabrics were then placed in a 300 ml autoclave having a gas compressor and an extraction system. The stained cloth was hung from the bottom of the autoclave's overhead stirrer using a copper wire to promote good agitation during washing and extraction. After placing the cloth in the autoclave and sealing it, liquid $CO_2$ at a tank pressure of 850 psi was allowed into the system and was heated to reach a temperature of about 40° C. to 45° C. When the desired temperature was reached in the autoclave, the pressure inside the autoclave was increased to 4,000 psi by pumping in more $CO_2$ with a gas compressor. The stirrer was then turned on for 15 minutes to mimic a wash cycle. At the completion of the wash cycle, 20 cubic feet of fresh $CO_2$ were passed through the mimic a rinse cycle. The pressure of the autoclave was then released to atmospheric pressure and the cleaned cloths were removed from the autoclave. To measure the extent of cleaning, the cloths were placed in Reflectometer supplied by Colorguard. The R scale, which measures darkness from black to white, was used to determine stain removal. Cleaning results were reported as the percent stain removal according to the following calculation:

| | Surfactant | Trade Name | HLB |
|---|---|---|---|
| 1 | $CF_3(CF_2)_8CH_2H_2O(CH_2CH_2O)_8H$ | Zonyl FSN[2] | 2.1 |
| 2 | $CF_3(CF_2)_8CH_2CH_2O(CH_2CH_2O)_{12}H$ | Zonyl FSO[3] | 3.4 |
| 3 | $CF_3(CF)_8CH_2CH_2C(O)O(CH_2)_{10}CH_3$ | — | 4.6 |
| 4 | $CF_3(CF_2)_{12}CH_2CH_2C(O)O(CH_2)_8CH_3$ | — | 7.1 |
| 5 | $CF_3(CF_2)_8CH_2CH_2C(O)ONa$ | — | 17.3 |
| 6 | $CF_3(CF_2)_{12}CH_2CH_2C(O)ONa$ | — | 13.8 |
| 7 | $CF_3(CF_2)_3CH_2CH_2SO_3Na$ | Zonyl TBS[4] | 9.2 |
| 8 | $CF_3(CF_2)_{12}CH_2CH_2SO_3Na$ | | 5.7 |
| 9 | $HO(CH_2CH_2O)_3(CH(CH_3)CH_2O)_{30}(CH_2CH_2O)_3H$ | Pluronic L61[5] | 3.0 |
| 10 | $HO(CH_2CH_2O)_2(CH(CH_3)CH_2O)_{16}(CH_2CH_2O)_2H$ | Pluronic L31[6] | 4.5 |
| 11 | $HO(CH_2CH_2O)_8(CH(CH_3)CH_2O)_{30}(CH_2CH_2O)_8H$ | Pluronic L62[7] | 7.0 |
| 12 | $(CH_2CH_2O)_7(CH(CH_3)CH_2O)_{21}(CH_2CH_3O)_7H$ | Pluronic L43[8] | 12.0 |
| 13 | $HO(CH(CH_3)CH_2O)_{12}(CH_2CH_2O)_9(CH_2CH(CH_3)O)_{12}H$ | Pluronic 17R2[9] | 8.0 |
| 14 | Polyethylene glycol surfactant (PEG) | Akyporox NP 1200 V[10] | 19.2 |
| 15 | PEG 100- Laurate | | 19.1 |
| 16 | Linear alkylene benzene sulfonate | | 20.0 |
| 17 | Sodium lauryl sulfate | | 40.0 |
| 18 | Sodium Cocoyl Sarcosinate | | 27.0 |

[1]Attwood. D.: Florence. A. T. "Surfactant Systems: Their chemistry, pharmacy and biology". Chapman and Hall. NY. 1983. pp. 472–474.
[2–4]Supplied by Dupont.
[5–9]Supplied by BASF.
[10]Supplied by Chem-Y GmbH of Germany.

$$\%\ \text{stain removal} = \frac{\text{stain removed}}{\text{stain applied}} = \frac{\text{cleaned cloth reading} - \text{stained cloth reading}}{\text{unstained cloth reading} - \text{stained cloth reading}} \times 100$$

The cleaning results for the cotton and wool cloths dry cleaned with supercritical fluid carbon dioxide alone are in Table 1 below.

TABLE 1

Dry Cleaning Results on Several Hydrophobic Stains Using Supercritical Carbon Dioxide Only As Cleaning Medium

| Stain | Cloth | % Stain Removal |
|---|---|---|
| Ragu spaghetti sauce | Cotton | 95 |
| Sebum | Wool | 99 |
| Olive Oil with Blue Dye | Wool | 97 |
| Lipstick | Wool | * |

The results confirm what was known in the art: the hydrophobic stains are substantially removed with supercritical fluid carbon dioxide alone. However, the lipstick stain, which is a compound hydrophobic stain with pigment particulates, was removed only to the extent of its waxy components. The colored portion of the stain fully remained.

EXAMPLE 3

The hydrophilic stain, grape juice, was dry cleaned using supercritical fluid carbon dioxide, a polydimethylsiloxane surfactant, water as a modifier and mixtures thereof according to the invention.

Two inch by three inch polyester cloths were cut and stained with concentrated grape juice which was diluted 1:10 with water. The grape juice stain was then dried and was approximately 2 wt. % and 7 wt. % grape juice stain after drying. The cloths were then placed in the autoclave as described in Example 2, except these experiments were run at a pressure of 6,000 psi.

Two different polydimethylsiloxane surfactants were used alone or in combination with 0.5 ml of water and supercritical fluid carbon dioxide. The control was supercritical fluid carbon dioxide alone.

The water was added directly to the bottom of the autoclave and not on the stain itself and the surfactant was applied directly to the stain on the cloth. After the wash and rinse cycles, cleaning results were evaluated and the results are reported in Table 2 below.

TABLE 2

Dry Cleaning Results on Grape Juice Stains Using Supercritical Carbon Dioxide and Polydimethylsiloxane Surfactant

| Stain | Cloth | Surfactant | Modifier | % Stain Removal |
|---|---|---|---|---|
| 2% grape juice | Polyester | None | None | 18 |
| 2% grape juice | Polyester | 0.2 g ABIL 88184[1] | None | 0 (darker) |
| 7% grape juice | Polyester | None | 0.5 ml water | 21 |
| 7% grape juice | Polyester | 0.2 g ABIL 88184 | 0.5 ml water | 49 |

TABLE 2-continued

Dry Cleaning Results on Grape Juice Stains Using Supercritical Carbon Dioxide and Polydimethylsiloxane Surfactant

| Stain | Cloth | Surfactant | Modifier | % Stain Removal |
|---|---|---|---|---|
| 7% grape juice | Polyester | 0.2 g ABIL 8851[2] | 0.5 ml water | 51 |

[1]A polydimethylsiloxane having a molecular weight of 13,200 and 5% of its siloxyl groups substituted with a 86/14 ethylene oxide/propylene oxide chain supplied by Goldschmidt of Virginia.
[2]A polydimethylsiloxane having a molecular weight of 7,100 and 14% of its siloxyl groups substituted with a 75/25 ethylene oxide/propylene oxide chain also supplied by Goldschmidt.

It was observed that the combination of water as a modifier with the selected polydimethylsiloxane surfactants improved dry cleaning results in supercritical fluid carbon dioxide. In fact, none of the three components alone removed substantially any of the grape juice stain.

EXAMPLE 4

As a comparison with the prior art, a conventional alkane surfactant was used alone or in combination with a modifier and supercritical $CO_2$ to dry clean the hydrophilic stain, grape juice, on polyester, as described in Example 3 above.

The surfactant, linear alkylenebenzene sulfonate is a solid and has an HLB value of 20. The LAS was added to the bottom of the autoclave with varying amounts of water. The following cleaning results were observed and are reported in Table 3 below.

TABLE 3

Dry Cleaning Results on Grape Juice Stains Using Supercritical Carbon Dioxide and Linear Alkylenebenzene Sulfonate Surfactant (LAS)

| Stain | Cloth | Surfactant | Modifier | % Stain Removal |
|---|---|---|---|---|
| 2% grape juice | Polyester | None | None | 18 |
| 7% grape juice | Polyester | 0.25 g LAS | 0.5 ml water | 0 (darker) |
| 7% grape juice | Polyester | 0.25 g LAS | 6.0 ml water | 75 |
| 2% grape juice | Polyester | 0.12 g LAS | 6.0 ml water | 84 |
| 2% grape juice | Polyester | 0.12 g LAS | 0.5 ml water | Stain moved on cloth |

It was observed that LAS was only effective in a larger amount of water (6 ml). When the modifier was reduced from 6 ml of 0.5 ml, the stain only wicked up the cloth and was not removed.

It is noted that DE 3904514 describes dry cleaning using supercritical fluid carbon dioxide in combination with a conventional surfactant. The publication exemplifies cleaning results with LAS. The experimental conditions in the examples state that the stained cloth has only minimal contact with supercritical fluid carbon dioxide, namely a 10 minute rinse only. It appears that the cleaning obtained with LAS and the large amount of water is similar to spot or wet cleaning, since the cloth remains wet at the end of the process. There appears to be little to minimal influence of the supercritical fluid carbon dioxide on spot removal under these conditions.

Additionally, in a dry cleaning process, the use of LAS with supercritical fluid carbon dioxide would not be possible with water-sensitive fabrics such as silks and wools since such large amounts of water are necessary.

EXAMPLE 5

A hydrophilic stain, namely grape juice, was dry cleaned using polydimethylsiloxane surfactants with water and supercritical fluid carbon dioxide according to the invention.

Polyester cloths were stained in 7% grape juice stain as described in Example 3 above. Two different polydimethylsiloxane surfactants were used with varying amounts of water and supercritical fluid carbon dioxide. In comparison, LAS, the conventional surfactant, used with the same amounts of water was used to remove the grape juice stains. The cleaning results for the two types of surfactants are reported in Table 4 below.

TABLE 4

Dry Cleaning Results on Grape Juice Stains Using Supercritical Carbon Dioxide and Surfactants with Increased Water Levels

| Stain | Cloth | Surfactant | Modifier | % Stain Removal |
|---|---|---|---|---|
| 7% grape juice | Polyester | 0.25 g. LAS | 6.0 ml water | 75 |
| 7% grape juice | Polyester | 0.25 g. LAS | 0.5 ml water | 0 (darker) |
| 7% grape juice | Polyester | 0.2 g ABIL 88184[3] | 6.0 ml water | 41 |
| 7% grape juice | Polyester | 0.2 g ABIL 88184 | 0.5 ml water | 49 |
| 7% grape juice | Polyester | 0.2 g ABIL 88184 | 6.0 ml water | 43 |
| 7% grape juice | Polyester | 0.2 g ABIL 8851[4] | 0.5 ml water | 51 |

[3]A polydimethylsiloxane having a molecular weight of 13,200 and 5% of its siloxyl groups substituted with a 86/14 ethylene oxide/propylene oxide chain supplied by Goldschmidt.
[4]A polydimethylsiloxane having a molecular weight of 7,100 and 14% of its siloxyl groups substituted with a 75/25 ethylene oxide/propylene oxide chain also supplied by Goldschmidt.

It was observed that the modified polydimethylsiloxane surfactants according to the invention are more effective in the presence of less water (0.5 ml vs. 6.0 ml) as cleaning was reduced from 50% to 40% when the water levels were increased. The opposite effect was observed with LAS, as strain removal increased from 0% to 75% as the water levels were increased to 6.0 ml. Thus, the claimed siloxane surfactants provide better cleaning results with less water which is beneficial for water sensitive fabrics.

EXAMPLE 6

Polydimethylsiloxanes having varying molecular weights and alkylene substituted moieties were tested as surfactants with supercritical fluid carbon dioxide in the inventive dry cleaning process. Various types of stained cloths were tested under the dry cleaning conditions described in Example 2 above.

A compound hydrophobic stain, red candle wax, was placed on both cotton fabrics as follows. A candle was lit and approximately 40 drops of melted wax were placed on each cloth so that a circular pattern was achieved. The cloths were then allowed to dry and the crusty excess wax layer was scraped off the top and bottom of each stain so that only a flat waxy colored stain was left.

Red candle wax was placed on the wool cloth by predissolving the red candle in hexane and then pipetting an amount of the hexane solution onto the fabric. The fabric was dried and the resulting fabric contained about 10 wt. % stain.

As stated above, the pressure of the autoclave during the washing cycle was 6000 psi at a temperature of 40° C. with a 15 minute cycle. Twenty cubic feet of supercritical fluid carbon dioxide was used for the rinse cycle.

Five types of modified polydimethylsiloxanes having formula V:

(V)

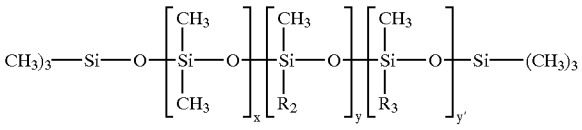

wherein x:y and y' ratio is $ 0.5:1 and R and R' are each independently a straight or branched $C_{1-30}$ alkylene chain were prepared. The compound formula is represented as $MD_xD^*_yM(C_z)$ wherein M represents the trimethylsiloxyl end groups, $D_x$ represents the dimethylsiloxane backbone ($CO_2$-philic), $D^*_y$ represents the substituted methylsiloxyl group ($CO_2$-phobic) and ($C_z$) represents the carbon length of the alkylene chain of R.

Molecular weights of the siloxanes ranged from 1,100 to 31,000. The polydimethylsiloxanes straight chain alkylene group ranged from $C_8$ to $C_{18}$ carbons. The red wax stained cloths were cleaned and the cleaning results were observed and are reported in Table 5 below. No modifier was used.

TABLE 5

Red Candle Wax Stains Dry Cleaned with Modified Polydimethylsiloxanes and Supercritcal Carbon Dioxide

| Stain | Cloth | Surfactant (0.2 g) | % Stain Removal |
|---|---|---|---|
| Red candle wax | Cotton | None | 13 |
| Red candle wax | Cotton | $MD_{100}D^*_2M$ ($C_{18}$)[5] | 20 |
| Red candle wax | Cotton | $MD_{400}D^*_8M$ ($C_8$)[6] | 38 |
| Red candle wax | Cotton | $MD_{15.3}D^*_{1.5}M$ ($C_{12}$)[7] | 60 |
| Red candle wax | Cotton | $MD_{27.0}D^*_{1.3}M$ ($C_{12}$)[8] | 64 |
| Red candle wax | Cotton | $MD_{12.4}D^*_{4.1}M$ ($C_{12}$)[9] | 59 |
| Red candle wax | Wool | None | 33 |
| Red candle wax | Wool | $MD_{15.3}D^*_{1.5}M$ ($C_{12}$) | 54 |

[5]A copolymer of polydimethylsiloxane and a stearyl substituted silicon monomer having a molecular weight of 8,200 and prepared as described in Hardman B., "Silicones" The Encyclopedia of Polymer Science and Engineering, v. 15, 2nd ed., J. Wiley and Sons, NY, NY (1989).
[6]A copolymer of polydimethylsiloxane and an octyl substituted hydrocarbon silicon monomer having a molecular weight of 31,000 and prepared as described in Hardman Supra.
[7]A copolymer of polydimethylsiloxane and a lauric substituted hydrocarbon silicon monomer having a molecular weight of 1,500 and prepared as described in Hardman Supra.
[8]A copolymer of polydimethylsiloxane and a lauric substituted hydrocarbon silicon monomer having a molecular weight of 2,450 and prepared as described in Hardman Supra.
[9]A copolymer of polydimethylsiloxane and a lauric substituted hydrocarbon silicon monomer having a molecular weight of 1,170 and prepared as described in Hardman Supra.

It was observed that the modified polydimethylsiloxanes in combination with supercritical fluid carbon dioxide significantly improved removal of a compound hydrophobic stain from both cotton and wool fabrics over the use of $CO_2$ alone. It was also observed that the lower molecular weight silicone surfactants (e.g., $MD_{12.4}D_{1.1}{}^*M(C_{12})$; $MD_{15.3}D^*_{1.5}M(C_{12})$; and $MD_{27.0}D^*_{1.1}M(C_{12})$) are more effective at stain removal than the silicone surfactants having higher molecular weights (e.g., $MD_{100}D^*_2M(C_{18})$ and $MD_{400}D^*_8M(C_8)$) regardless of chain length of the alkylene moiety. Especially beneficial were lower molecular weight silicones with chain lengths of $C_{10-14}$.

EXAMPLE 7

A glycerated siloxane surfactant having a formula $MD_xD^*_yM$ wherein $D^*_y$ is substituted by $—(CH_2)_3OCH_2CH(OH)CH_2OH$ was used to dry clean a grape juice stain on a polyester cloth under the dry cleaning conditions described in Example 2 above. About 0.2 gram of the surfactant was combined with 0.5 ml. water. The glycerated siloxane is a polydimethylsiloxane with a glycerol side chain having a molecular weight of 870 and prepared as described in Hardman. Supra.

It was observed that the glycerated siloxane removed 33% of the grape juice stain.

EXAMPLE 8

Various fluorinated surfactants, either alone or with water, were used with supercritical fluid carbon dioxide to clean several types of stained fabric under the dry cleaning conditions described in Example 2.

Specifically, the pressure in the autoclave was 4000 psi and the temperature was 40° C. to 45° C.

Cotton stained with red candle wax and polyester stained with grape juice were cleaned with the fluorinated surfactants and the following cleaning results were observed as reported in Table 6 below.

TABLE 6

Stains Dry Cleaned with Fluorinated Surfactants and Supercritical Fluid Carbon Dioxide

| Stain | Cloth | Surfactant | Modifier | % Stain Removal |
|---|---|---|---|---|
| Red candle wax | Cotton | None | None | 13 |
| Red candle wax | Cotton | 0.6 g Krytox ™[10] | None | 70 |
| 2% grape juice | Polyester | None | None | 18 |
| 2% grape juice | Polyester | ~0.25 g FSA[11] | 0.5 ml water | 11 |
| 2% grape juice | Polyester | 0.2 g FSO-100[12] | 1.0 ml water | 43 |
| 2% grape juice | Polyester | 0.2 g FSN[13] | 1.0 ml water | 48 |
| 2% grape juice | Polyester | ~0.2 g FSA | 1.0 ml water | 9 |

[10]A fluorinated polyether ammonium carboxylate suppled as Krytox ™ surfactant by DuPont, Inc. of Delaware.
[11]A fluorinated nonionic having a lithium carboxylate salt supplied under the Zonyl ® surfactant series by DuPont, Inc. of Delaware.
[12]A fluorinated nonionic surfactant supplied under the Zonyl ® surfactant series by DuPont, Inc. of Delaware.
[13]A fluorinated nonionic surfactant supplied under the Zonyl ® surfactant series by DuPont, Inc. of Delaware.

It was observed that all of the fluorinated surfactants equalled or improved dry cleaning of the tested stains over the use of supercritical fluid carbon dioxide alone. It was further observed that the fluorinated nonionic surfactants (FSO-100 and FSN) were more effective than the fluorinated nonionic having a lithium carboxylate salt (FSA).

EXAMPLE 9

Various bleaching peracids were combined with supercritical fluid carbon dioxide to dry clean stained fabrics.

The bleaching peracids tested include m-chloroperbenzoic acid (m-CPBA), p-nitroperbenzoic acid (p-NPBA) and 6-phthalimidoperoxy hexanoic acid (PAP) in an amount of about 0.2 to 0.5 grams each. Cotton stained with red candle wax was cleaned as described in Example 5. The wash cycle of the dry cleaning system was run at 6000 psi and 45° C. as described in Example 2. The coffee stains were applied to polyester and wool cloths.

At the end of the cleaning cycle, the stained cloths were evaluated and the results are reported below in Table 7.

TABLE 7

Stains Dry Cleaned with Bleaching Peracids and Supercritical Fluid Carbon Dioxide

| Stain | Cloth | Surfactant | Modifier | % Stain Removal |
|---|---|---|---|---|
| Red candle wax | Cotton | None | None | 13 |
| Red candle wax | Cotton | 0.5 g m-CPBA[14] | None | 94 |
| Red candle wax | Cotton | 0.11 g p-NPBA[15] | None | 72 |
| Red candle wax | Cotton | 0.26 g PAP[15] | None | 50 |
| Coffee | Polyester | 0.5 g m-CPBA | None | 45 |
| Coffee | Wool | None | None | 0 |

[14]m-chloroperbenzoic acid having a solubility of, 0.15 g at 1900 psi, at 45° C. in 59.8 g $CO_2$and supplied by Aldrich Chemical Co.
[15]p-nitroperbenzoic acid having a solubility of, 0.05 g at 1900 psi, at 45° C. in 59.8 g $CO_2$ and supplied by Aldrich Chemical Co.
[16]6-phthalimidoperoxy hexaneic acid having a solubility of 0.05 g at 2,000 psi, at 45° C. in 59.8 $CO_2$ supplied by Ausimont.

The results show that the three peroxides tested significantly improved stain removal on the two types of stains cleaned over supercritical fluid carbon dioxide alone.

EXAMPLE 10

Protease enzyme was used in supercritical carbon dioxide to clean spinach stains from cotton cloth. Three (3) mls of protease enzyme (Savinase supplied by Novo, Inc.) was added to buffered water to form a 1% solution and then added to each cloth. The cloths were then washed and rinsed as described in Example 2 above. The cleaning results observed and calculated are as shown in Table 8 below:

TABLE 8

Stains Drycleaned with Savinase in Supercritical Carbon Dioxide

| Stain | Cloth | Enzyme Solution | Modifier | % Stain Removal |
|---|---|---|---|---|
| Spinach | cotton | none | none | 6.9 |
| Spinach | cotton | Savinase | none | 26.5 |

These results show enhanced cleaning of the spinach stain over supercritical carbon dioxide alone when the enzyme is added to the system.

EXAMPLE 11

Lipolase enzyme (1% enzyme solution of 3 mls in buffered water) was used in supercritical carbon dioxide to clean red candle wax stains from rayon cloth. The procedure used was identical to that of Example 10. The results are summarized in Table 9 below.

TABLE 9

Stains Dry Cleaned with Lipolase in Supercritical Carbon Dioxide

| Stain | Cloth | Enzyme Solution | Modifier | % Stain Removal |
|---|---|---|---|---|
| Red Candle Wax | rayon | none | none | 51 |
| Red Candle Wax | rayon | Lipolase | none | 60 |
| Red Candle Wax | cotton | none | none | 13 |
| Red Candle Wax | cotton | Lipolase | none | 64 |

The results in Table 9 show enhanced cleaning of the red candle wax stain when lipolase is used in conjunction with supercritical carbon dioxide, on both rayon and cotton cloths.

EXAMPLE 12

Amylase enzyme (1% enzyme solution of 3 mls enzyme in buffered water) was used to dryclean starch/azure blue stains on wool cloth in supercritical carbon dioxide. The blue dye is added to make the starch stain visible so that its removal may be detected by the reflectometer. The drycleaning procedure used was identical to that of example 10, and the results are presented in Table 10 below.

TABLE 10

Dry Cleaning of Starch/Azure Blue Dye Stains on Wool Using Amylase in Supercritical Carbon Dioxide

| Stain | Cloth | Enzyme Solution | Modifier | % Stain Removal |
|---|---|---|---|---|
| Starch/Azure Blue | wool | none | none | cloth gets darker |
| Starch/Azure Blue | wool | Termamyl | none | 25.6 |

The results in Table 10 show that the Termamyl enzyme is effective at cleaning the starch stain from wool cloth in supercritical carbon dioxide.

EXAMPLE 13

Dry cleaning of grape juice stain was conducted on cloths other than polyester fabric. The experiments on rayon and silk cloth were conducted using the same procedure as in Example 3, using cloths with 2 wt. % grape juice stains with water as a modifier at pressures of 6000 psi and 4000 psi as noted in Table 11.

TABLE 11

Dry Cleaning of Grape Juice Stains on Rayon and Silk Using Supercritical Carbon Dioxide and Polydimethylsiloxane Surfactant

| Stain | Cloth | Pressure | Surfactant | Modifier | % Stain Removal |
|---|---|---|---|---|---|
| Grape Juice | rayon | 6000 psi | none | 0.5 ml water | 2.4 |
| Grape Juice | rayon | 6000 psi | 0.2 g Abil 88184 | 0.5 ml water | 75.5 |
| Grape Juice | silk | 6000 psi | none | 0.5 ml water | 2.0 |
| Grape Juice | silk | 6000 psi | 0.2 g Abil 88184 | 0.5 ml water | 30.4 |
| Grape Juice | silk | 4000 psi | none | 0.5 ml water | 3.9 |
| Grape Juice | silk | 4000 psi | 0.2 g Abil 88184 | 0.5 ml water | 27.5 |

These results show significantly enhanced cleaning of the grape juice stain on rayon and silk when the polydimethylsiloxane surfactant Abil 88184 is added to the supercritical carbon dioxide dry cleaning system.

EXAMPLE 14

Dry cleaning of red candle wax stains was conducted on several different types of fabric, using an alkylene modified polydimethylsiloxane surfactant. $MD_{15.3}D^*_{1.5}M(C_{12})$, having a molecular weight of 1475 g/mole. The surfactant was synthesized as described in Hardman, Supra. The dry cleaning procedure used was the same as that used in example 5, and the cleaning results are presented in the following table.

TABLE 12

Dry Cleaning of Red Candle Wax Stains on Various Fabrics Using an Alkylene-Modified Polydimethylsiloxane Surfactant in Supercritical Carbon Dioxide

| Stain | Cloth | Surfactant | % Stain Removal |
|---|---|---|---|
| Red Candle Wax | cotton | none | 13.0 |
| Red Candle Wax | cotton | 0.2–0.3 g $MD_{15.3}D^*_{1.5}M(C_{12})$ | 52.9 |
| Red Candle Wax | wool | none | 36.0 |
| Red Candle Wax | wool | 0.2–0.3 g $MD_{15.3}D^*_{1.5}M(C_{12})$ | 51.6 |
| Red Candle Wax | silk | none | 61.3 |
| Red Candle Wax | silk | 0.2–0.3 g $MD_{15.3}D^*_{1.5}M(C_{12})$ | 77.3 |
| Red Candle Wax | rayon | none | 51.2 |
| Red Candle Wax | rayon | 0.2–0.3 g $MD_{15.3}D^*_{1.5}M(C_{12})$ | 50.1 |

The dry cleaning results show significantly enhanced cleaning of the red candle wax stain on all fabrics except for rayon, which shows no cleaning enhancement from addition of the surfactant. The cleaning results for the silk cloth are especially high, giving a cloth which looks very clean to the eye.

EXAMPLE 15

Dry cleaning of grape juice on polyester cloth and of red candle wax on cotton cloth was investigated at different pressures to determine the effect of the pressure of supercritical carbon dioxide on the cleaning effectiveness of the system. The dry cleaning procedures used were the same as those used in examples 3 and 6 except for the variations in pressure, and the results are presented in the following table.

TABLE 13

Dry Cleaning of Grape Juice and Red Candle Wax Stains at Different Pressures

| Stain | Cloth | Pressure | Surfactant | Modifier | % Stain Removal |
|---|---|---|---|---|---|
| Red Candle Wax | cotton | 6000 psi | $MD_{15.3}D^*_{1.5}M$ ($C_{12}$) | none | 52.9 |
| Red Candle Wax | cotton | 3000 psi | $MD_{15.3}D^*_{1.5}M$ ($C_{12}$) | none | 51.0 |
| Red Candle Wax | cotton | 2000 psi | $MD_{15.3}D^*_{1.5}M$ ($C_{12}$) | none | 39.3 |
| Grape Juice | polyester | 6000 psi | Abil 88184 | 0.5 ml water | 61.0 |
| Grape Juice | polyester | 4000 psi | Abil 88184 | 0.5 ml water | 55.4 |
| Grape Juice | polyester | 3000 psi | Abil 88184 | 0.5 ml water | 33.8 |

The results presented in the table show that the cleaning of red candle wax stains diminishes between 3000 and 2000 psi, while the cleaning of grape juice stains diminishes between 4000 and 3000 psi.

EXAMPLE 16

Further dry cleaning experiments were conducted on polyester stained with grape juice using other ethylene oxide/propylene oxide modified polydimethylsiloxane surfactants. The cleaning efficacy of these surfactants was compared to that of the Abil 88184 surfactant, whose cleaning results are presented in example 3. The dry cleaning procedure used was that same as that in example 2. Water (0.5 ml) was applied to the stained cloth before each experiment was conducted. The results are presented in the following table.

TABLE 14

Dry Cleaning of Grape Juice on Polyester in Supercritical Carbon Dioxide and Polydimethylsiloxane Surfactants

| Stain | Cloth | Surfactant | Pressure | % Stain Removal |
|---|---|---|---|---|
| Grape Juice | polyester | Abil 88184[17] | 6000 psi | 60.6 |
| Grape Juice | polyester | Abil 88184[1] | 4000 psi | 55.4 |
| Grape Juice | polyester | Abil 8878[18] | 4000 psi | 38.6 |
| Grape Juice | polyester | Abil 8848[19] | 4000 psi | 41.5 |
| Grape Juice | polyester | $MD_{12.7}D^*_1M$ $EO_{10}$[20] | 6000 psi | 41.4 |
| Grape Juice | polyester | $MD_{20}D^*_2M$ $EO_{10}$[21] | 6000 psi | 43.7 |

[17]A polydimethylsiloxane having a molecular weight of 13,200 and 5% of its siloxyl groups substituted with a 86.14 ethylene oxide/propylene oxide chain. Supplied by Goldschmidt.
[18]A polydimethylsiloxane having a molecular weight of 674 and having one siloxyl group substituted with a 100% ethylene oxide chain. Supplied by Goldschmidt.
[19]A polydimethylsiloxane having a molecular weight of 901 and having one siloxyl group substituted with a 8.5/4.5 ethylene oxide/propylene oxide chain. Supplied by Goldschmidt.
[20]A polydimethylsiloxane having a molecular weight of 1660 and 6.4% of its iloxyl groups substituted with a 100% ethylene oxide chain. Synthesized according to Hardman, Supra.
[21]A polydimethylsiloxane having a molecular weight of 2760 and 8.3% of its iloxyl groups substituted with a 100% ethylene oxide chain. Synthesized according to Hardman, Supra.

The dry cleaning results in the table show that all of the surfactants tested are effective at removing the grape juice stain from the polyester cloth, although the Abil 88184 is slightly better, even when the pressure is reduced to 4000 psi. A dry cleaning run with no surfactant cleans only 21% of the grape juice stain.

EXAMPLE 17

The following tables show dry cleaning results on grape juice stains made on polyester cloth where the stained cloths were prepared by dipping the entire cloth in the staining solution. The cloths are prepared with 2 wt. % stain, and otherwise, the drycleaning procedure is identical to that of Example 3, including the use of 0.5 ml water on each cloth prior to cleaning.

TABLE 15

Dry Cleaning of Dipped Grape Juice Stains Using Modified Polydimethylsiloxane Surfactants in Supercritical Carbon Dioxide

| Stain | Cloth | Surfactant | Pressure | % Stain Removal |
|---|---|---|---|---|
| Grape Juice | polyester | Abil 88184[22] | 6000 psi | 50.2 |
| Grape Juice | polyester | $MD_{20}D^*_2M$ $EO_{10}$[23] | 6000 psi | 48.0 |
| Grape Juice | polyester | $MD_{20}D^*_2M$ $EO_{10}$[2] | 3000 psi | 30.9 |
| Grape Juice | polyester | $MD_{20}D^*_2M$ $EO_{10}$[2] | 4000 psi | 46.1 |
| Grape Juice | polyester | $MD_{12.7}D^*_1M$ $EO_{10}$[24] | 4000 psi | 51.5 |

[22]A polydimethylsiloxane having a molecular weight of 13,200 and 5% of its siloxyl groups substituted with a 86:14 ethylene oxide/propylene oxide chain. Supplied by Goldschmidt.
[23]A polydimethylsiloxane having a molecular weight of 2760 and 8.3% of its siloxyl groups substituted with a 100% ethylene oxide chain. Synthesized according to Hardman Supra.
[24]A polydimethylsiloxane having a molecular weight of 1660 and 6.4% of its siloxyl groups substituted with a 100% ethylene oxide chain. Synthesized according to Hardman Supra.

The dry cleaning results presented in this table show that the synthesized surfactants (entries 2 and 3) are just as effective at cleaning as Abil 88184. In addition, the new surfactants are just as effective at 4000 psi as they are at 6000 psi, although their cleaning ability diminishes somewhat at 3000 psi.

EXAMPLE 18

These experiments comprised the cleaning of both red candle wax and grape juice stains simultaneously in the high pressure autoclave. One of each stained cloth was used with its respective surfactant and modifier (i.e. water added to the grape juice stained cloth). The grape juice stained cloth was prepared by the dipping method. Dry cleaning was conducted as described in example 2 and 5, at 6000 psi and 43–45° C., and the results are presented in the following table.

TABLE 16

Mixed Cloth Dry Cleaning in Supercritical Carbon Dioxide

| Cloth/Stain | Surfactant | % Stain Removal |
|---|---|---|
| Red Wax/Cotton | 0.5 g Krytox ™ | 77.2 |
| Grape Juice/Polyester | 0.2 g $MD_{12.7}D^*_1M$ $EO_{10}$ | 45.9 |
| Red Wax/Cotton | 0.5 g Krytox ™ | 71.0 |
| Grade Juice/Polyester | 0.2 g Abil 88184 | 29.8 |
| Red Wax/Cotton | 0.2 g $MD_{15.3}D^*_{15}M$ $C_{12}$ | 50.4 |
| Grape Juice/Polyester | 0.2 g $MD_{12.7}D^*_1M$ $EO_{10}$ | 52.8 |

The results in the table show that the surfactants provide compatible amounts of cleaning of both stains, except for the combination of Krytox® with Abil 88184, (entry 2), where the effectiveness of the Abil 88184 at cleaning the grape juice is diminished. The cleaning ability of the Krytox on red candle wax is actually enhanced somewhat in combination with polydimethylsiloxane surfactants.

EXAMPLE 19

Carbon dioxide was used as a cleaning medium to dry-clean stains on rayon fabric. The stained fabrics were prepared by taking two by three inch cloths and applying stains directly to the cloths. The cloths were then allowed to dry. The stained cloths were then placed in a 300 ml autoclave having a carbon dioxide supply and extraction system. Each stained cloth was hung from the bottom of the overhead stirrer of the autoclave using a copper wire to promote good agitation during washing and rinsing. After placing the cloth in the autoclave with any surfactant and/or modifier and sealing it, carbon dioxide at tank pressure (approx 830 psi) was allowed into the system by opening a valve between the tank and the autoclave. The autoclave was cooled to the desired temperature by using a cooling solution that was pumped through an internal condenser by a circulating pump. When the desired temperature and pressure were reached in the autoclave, the valve was closed and the stirrer was turned on for a wash cycle of 15 minutes. At the completion of the wash cycle, the valve to the tank and the valve to the extractor were opened, and fresh carbon dioxide (20 cu ft) was allowed to flow through the system to mimic a rinse cycle. The pressure of carbon dioxide was then released to atmospheric pressure and the cleaned cloth was removed from the autoclave. To measure the extent of cleaning, the cloths were placed on a Reflectometer$^R$ supplied by Colorguard. The R scale, which measure darkness form black to white, was used to determine stain removal.

Cleaning results were reported as the percent stain removal according to the following calculation:

$$\%\ \text{stain removal} = \frac{\text{stain removed}}{\text{stain applied}} = \frac{\text{cleaned cloth reading} - \text{stained cloth reading}}{\text{unstained cloth reading} - \text{stained cloth reading}} \times 100$$

EXAMPLE 20

The hydrophilic stain grape juice was drycleaned using carbon dioxide alone, and using carbon dioxide in conjunction with water and a polydimethylsiloxane surfactant according to the invention. Two inch by three inch rayon cloths were cut and stained with grape juice concentrate which was diluted 1:10 with water. The stains were allowed to dry and were approximately 2% by weight after drying.

The cloths were then cleaned as described in Example 19, using carbon dioxide alone as a control and carbon dioxide with water and a polydimethylsiloxane surfactant modified with an ethylene oxide chain of ten repeat units, at two temperature levels of approximately 10° C. and 15° C. and a pressure of 700–800 psi.

The cleaning results for grape juice stained rayon cleaned with carbon dioxide are reported below.

TABLE 17

Drycleaning of Grape Juice Stained Rayon in Carbon Dioxide

| Stain | Cloth | Surfactant | Modifier | Wash Temp. | Rinse Temp. | % Clean |
|---|---|---|---|---|---|---|
| grape juice | rayon | none | none | 7–8° C. | 9–10° C. | −0.4 |
| grape juice | rayon | none | none | 15° C. | 15–17° C. | −0.2 |
| grape juice | rayon | 0.2 g $EO_{10}MD_{12.7}D^*M$[25] | 0.5 g water | 15–16° C. | 16–18° C. | 52 |
| grape juice | rayon | 0.2 g $EO_{10}MD_{12.7}D^*M$ | 0.5 g water | 8–9° C. | 10–11° C. | 36 |

[25]A copolymer of polydimethylsiloxane having a molecular weight of 1660 and 6.4% of its siloxyl groups substituted with a 100% ethylene oxide chain. Prepared as described in Hardman, B. "Silicones" The Encylopedia of Polymer Science and Engineering. Vol. 15. 2nd ed., J. Wiley & Sons, New York, NY (1989)

The results in Table 17 show that drycleaning in densified carbon dioxide under these conditions is effective at removing grape juice stains from rayon when a surfactant and water are used in combination with the carbon dioxide.

EXAMPLE 21

The hydrophobic stain red candle wax was drycleaned using carbon dioxide alone, and using carbon dioxide in conjunction with surfactants according to the invention. Two inch by three inch rayon cloths were stained with approximately 40 drops of melted red candle wax which were applied in a circular pattern. The cloths were then allowed to dry and the excess wax layer was scraped from the top and bottom of each stain so that only a flat, waxy colored stain remained.

The cloths were then cleaned as described in Example 19, using carbon dioxide alone as a control, and carbon dioxide and surfactants such as Krytox™, a fluorinated polyether carboxylate supplied by DuPont, Inc. of Delaware, which was converted to its ammonium salt; and a polydimethylsiloxane surfactant modified with a $C_{12}$ alkylene chain, abbreviated as $MD_{15.3}D_{1.5}M$ $C_{12}$. The experiments were conducted at a pressure of 700–800 psi and at two temperature levels, about 10° C. and about 15° C.

TABLE 18

Drycleaning of Red Candle Wax Stained Rayon in Carbon Dioxide

| Stain | Cloth | Surfactant | Wash Temp | Rinse Temp. | % Clean |
|---|---|---|---|---|---|
| red candle wax | rayon | none | 9–10° C. | 10–12° C. | 41 |
| red candle wax | rayon | none | 16–17° C. | 16–17° C. | 52 |
| red candle wax | rayon | $MD_{15.2}D^*_{15}M$ $C_{12}$[26] | 9° C. | 10–11° C. | 79 |
| red candle wax | rayon | Krytox ™[27] | 15° C. | 16–17° C. | 81 |
| red candle wax | rayon | Krytox ™ | 9° C. | 10–12° C. | 80 |

[26]A copolymer of polydimethylsiloxane and a lauric substituted hydrocarbon silicon monomer having a molecular weight of 1,500 and prepared as described in Hardman, Supra.
[27]A fluorinated polyether ammonium carboxylate surfactant supplied as the acid by DuPont, Inc. of Delaware.

The results in Table 18 show that the addition of a surfactant to the system provides greatly improved cleaning of the red candle wax stain over carbon dioxide alone.

EXAMPLE 22

The hydrophilic stain grape juice was drycleaned using carbon dioxide alone, and using carbon dioxide in conjunction with water and a polydimethylsiloxane surfactant according to the invention. Two inch by three inch rayon cloths were cut and stained with grape juice concentrate which was diluted 1:10 with water. The stains were allowed to dry and were approximately 7% by weight after drying.

The cloths were then cleaned as described in Example 19, using carbon dioxide alone as a control, with water only, with a polydimethylsiloxane surfactant modified with an ethylene oxide chain of ten units, and with the surfactant plus water, at a wash temperature of about 6–9° C. and a rinse temperature of about 9–12° C. The pressure ranged from about 500 to about 800 psi.

TABLE 19

Drycleaning of Grape Juice Stained Rayon in Carbon Dioxide

| Stain | Cloth | Surfactant | Modifier | Wash Temp. | Rinse Temp. | % Clean |
|---|---|---|---|---|---|---|
| grape juice | rayon | none | none | 7–8° C. | 9–10° C. | −0.4 |
| grape juice | rayon | none | 0.5 g water | 7–8° C. | 9–11° C. | 11 |
| grape juice | rayon | 0.2 g $EO_{10}$ $MD_{12.7}D^*M$[28] | none | 6–8° C. | 10–12° C. | 48 |
| grape juice | rayon | 0.2 g $EO_{10}$ $MD_{12.7}D^*M$ | 0.5 g water | 9° C. | 10–11° C. | 36 |
| grape juice | rayon | 0.2 g $EO_{10}$ $MD_{20}D^*_2M$[29] | none | 7–8° C. | 10–11° C. | 48 |
| grape juice | rayon | 0.2 g $EO_{10}$ $MD_{20}D^*_2M$ | 0.5 g water | 8–9° C. | 8–10° C. | 42 |

[28]A polydimethylsiloxane having a molecular weight of 1660 and 6.4% of its siloxyl groups substituted with a 100% ethylene oxide chain. Synthesized according to Hardman, Supra.
[29]A polydimethylsiloxane having a molecular weight of 2760 and 8.3% of its siloxyl groups substituted with a 100% ethylene oxide chain. Synthesized according to Hardman, Supra.

The drycleaning results show that the system is effective at removing the grape juice stain from the rayon over carbon dioxide alone, and that the addition of surfactant, and surfactant plus water provide greater stain removal than the addition of only water to the system.

EXAMPLE 23

The hydrophilic stain grape juice was drycleaned using carbon dioxide alone, and using carbon dioxide in conjunction with water and a polydimethylsiloxane surfactant according to the invention. Two inch by three inch rayon cloths were cut and stained with grape juice concentrate which was diluted 1:10 with water. The stains were allowed to dry and were approximately 7% by weight after drying.

The cloths were then cleaned as described in Example 19, using carbon dioxide alone as a control, with water only, with a polydimethylsiloxane surfactant modified with an ethylene oxide/propylene oxide chain, and with the surfactant plus water, at a wash temperature of about 6–1° C. and a rinse temperature of a bout 9–15° C. The pressure ranged from about 700 to about 800 psi.

TABLE 20

Drycleaning of Grape Juice Stained Rayon in Carbon Dioxide

| Stain | Cloth | Surfactant | Modifier | Wash Temp. | Rinse Temp. | % Clean |
|---|---|---|---|---|---|---|
| grape juice | rayon | none | none | 7–8° C. | 9–10° C. | −0.4 |

TABLE 20-continued

| Drycleaning of Grape Juice Stained Rayon in Carbon Dioxide | | | | | | |
|---|---|---|---|---|---|---|
| Stain | Cloth | Surfactant | Modifier | Wash Temp. | Rinse Temp. | % Clean |
| grape juice | rayon | none | 0.5 g water | 7–8° C. | 9–11° C. | 11 |
| grape juice | rayon | ABIL 88184[30] | none | 9–10° C. | 9–10° C. | 33 |
| grape juice | rayon | ABIL 38184 | 0.5 g water | 6–9° C. | 10–15° C. | 26 |

[30]A polydimethylsiloxane surfactant having a molecular weight of 13,200 and 5% of its siloxyl groups substituted with a 86/14 ethylene oxide/propylene oxide chain supplied by Goldschmidt of Virginia.

The drycleaning results show that the system is effective at removing the grape juice stain from the rayon over carbon dioxide alone, and that the addition of surfactant, and surfactant plus water provide greater stain removal than the addition of only water to the system.

EXAMPLE 24

The hydrophilic stain, grape juice was dry cleaned using liquid carbon dioxide, and mixtures of liquid carbon dioxide, polydimethylsiloxane surfactant, and water according to the invention. This example demonstrates that there is a critical amount of water necessary for superior stain removal.

8.75"×4.75" cloths had a 2" diameter circle inscribed in pensil in the middle and concentrated grape juice which was diluted 1:4 with water was applied using a micropipet to the inside of the circles and spread to the edges of the circle. The following amounts were used: on polyester and wool, 475 microliters; on cotton 350 microliters; and on silk, 2 applications of 200 microliters with 15 minutes in between applications. The cloths were then dried overnight. Four replicates of each cloth type (for a total of 12 cloths) were placed in the cleaning chamber of a $CO_2$ dry cleaning unit constructed as taught in U.S. Pat. No. 5,467,491 and employing hydrodynamic agitation of garments by use of appropriately angled nozzles. To simulate a full load of clothes. 1.5 pounds of cotton ballast sheets (11"×11") were also placed in the cleaning chamber. The dry clearing unit employed had a cleaning chamber which holds about 76 liters of liquid $CO_2$. The piping in the cleaning loop held an additional 37 liters for a total volume in the cleaning loop of 113 liters. There was also a storage tank on the unit from which the fresh liquid $CO_2$ was added once the chamber door was closed and sealed. The cleaning cycle lasted for 15 minutes at about 850 psi and 11 degrees Celsius. After the cleaning cycle, the liquid $CO_2$ in the cleaning loop was pumped back into the storage tank, and the chamber door opened. To measure the extent of cleaning, spectrophotometric readings were taken on the washed grape juice cloths using a Hunter Ultrascan XE[7] spectrophotometer. The L,a,b scale was used to measure cleaning. Cleaning results were reported as stain removal index values (SRI's) using the following calculation:

$$SRI = 100 - \sqrt{(L_{washed} - L_{clean})^2 + (a_{washed} - a_{clean})^2 + (b_{washed} - b_{clean})^2}$$

where,

L measures black to white differences, a measures green to red differences and, b measures blue to yellow differences.

Four experiments were run—concentrations are in weight/volume of $CO_2$.

1. no additive (liquid $CO_2$ alone)
2. 0.05% Silwet L-7602+0.01% water
3. 0.05% Silwet L-7602+0.075% water
4. 0.05% Silwet L-7602+0.1% water Silwet L-7602 is a silicone surfactant which is ethylene oxide modified, has a MW=3000, and is available from Witco Co.

Surfactant and water were premixed and added directly to the bottom of the clearing chamber below the ballast and not on the stains themselves. After the wash cycle removal of $CO_2$ from the cleaning chamber, cleaning results were evaluated, and are reported in Table 1 below.

| Stain | Fabric | Experiment Number | Stain Removal Index |
|---|---|---|---|
| grape juice | wool (LSD* = 4.90) | 4 | 93.56 |
| | | 2 | 68.73[a] |
| | | 1 | 65.06[a] |
| | | 3 | 64.50[a] |
| | polyester (LSD = 3.51) | 4 | 94.56 |
| | | 2 | 65.09[a] |
| | | 3 | 63.02[a,b] |
| | | 1 | 61.41[b] |
| | cotton (LSD = 1.03) | 4 | 74.89 |
| | | 2 | 64.40 |
| | | 3 | 62.85 |
| | | 1 | 61.35 |

The fact that the experiment employing 0.5% surfactant and 0.1% water was superior on all three cloth types shows that there is a criticality on how much water is needed to achieve such cleaning. In the experiments employing less water than 0.1%, significantly less cleaning was achieved.

We claim:

1. A dry cleaning system for removing soil from fabric comprising:

(a) densified carbon dioxide wherein the densified carbon dioxide is at a temperature from about 0° C. to about 40° C. and a pressure from about 500psi to about 10,000 psi;

(b) a hydrocarbon of fluorocarbon containing surfactant having a HLB of less than 15, said HLB being estimated by the formula:

$$HLB = 7 + \Sigma(\text{hydrophilic group numbers}) - \Sigma(\text{lipophilic group numbers});$$

and (c) a cleaning vessel for containing the densified carbon dioxide and surfactant wherein carbon dioxide is heated and separated from soil within the dry cleaning system, and condensed to a liquid within the dry cleaning system.

2. The dry cleaning system for removing soil form fabric according to claim 1 wherein the dry cleaning system further comprises the formation of reverse micelles.

3. The dry cleaning system for removing soil from fabric according to claim 2 wherein the reverse micelles are formed by a carbon dioxide phobic portion and a carbon dioxide philic portion on the surfactant.

4. The dry cleaning system for removing soil from fabric according to claim 1 wherein the dry cleaning system further comprises water.

5. The dry cleaning system for removing soil form fabric according to claim 1 wherein the system comprises from about 0.001% to about 10% by weight of the surfactant.

6. A dry cleaning system for removing stains from fabrics comprising:

a) densified carbon dioxide wherein the densified carbon dioxide is at a temperature from about 0° C. to about 40° C. and a pressure from about 500psi to about 10,000 psi; and b) from about 0.001% to about 10% by weight of a hydrocarbon or fluorocarbon containing surfactant having an HLB of less than 15 comprising at least a densified carbon dioxide-philic moiety and a densified carbon dioxide-phobic moiety; and c) a cleaning vessel wherein the carbon dioxide philic moiety of the surfactant extends into a continuous phase formed by the densified carbon dioxide and the carbon dioxide-phobic moiety extends into a core of a resulting reverse micelle.

7. The dry cleaning system for removing soil from fabrics according to claim 6, wherein the system further comprises a modifier.

8. The dry cleaning system for removing soil from fabrics according to claim 7 wherein the modifier is water or an organic solvent.

9. The dry cleaning system for removing soil from fabrics according to claim 7 wherein the modifier is present in the core of the reverse micelle.

10. The dry cleaning system for removing soil from fabrics according to claim 6 wherein the densified carbon dioxide-philic moiety is a polysiloxane and the carbon dioxide-phobic moiety is a $CO_2$-phobic polyalkylene oxide.

11. A method for dry cleaning a substrate in a dry cleaning system comprising the steps of:

(a) contacting the substrate in a cleaning vessel with densified carbon dioxide wherein the densified carbon dioxide is at a temperature from about 0° C. to about 40° C. and a pressure from about 500psi to about 10,000 psi, comprising a hydrocarbon or fluorocarbon containing surfactant having a HLB of less than 15, said HLB being estimated by the formula:

$$HLB=7+\Sigma(\text{hydrophic group numbers})-\Sigma(\text{lipophilic group numbers});$$

and (b) removing the substrate from contact with the densified carbon dioxide wherein carbon dioxide is a heated and separated from soil within the dry cleaning system, and condensed to a liquid within the dry cleaning system.

12. The method for dry cleaning a substrate according to claim 11 wherein the dry cleaning takes place in a dry cleaning vessel and the substrate is a soiled fabric.

* * * * *